United States Patent [19]

Rosen et al.

[11] Patent Number: 4,767,449

[45] Date of Patent: Aug. 30, 1988

[54] PROCESS FOR AGGLOMERATING ORE CONCENTRATE UTILIZING CLAY AND DISPERSIONS OF POLYMER BINDERS OR DRY POLYMER BINDERS

[75] Inventors: Meyer R. Rosen, Bedminister; Gregory J. Dornstauder, Piscataway; Lawrence Marlin, Bridgewater, all of N.J.

[73] Assignee: Union Carbide Corporation, Danbury, Conn.

[21] Appl. No.: 63,990

[22] Filed: Jun. 19, 1987

Related U.S. Application Data

[63] Continuation-in-part of Ser. No. 903,968, Sep. 5, 1986, which is a continuation-in-part of Ser. No. 736,237, May 21, 1985, abandoned, and a continuation-in-part of Ser. No. 875,250, Jun. 17, 1986, which is a continuation of Ser. No. 773,700, Sep. 9, 1985, abandoned.

[51] Int. Cl.[4] ..... C22B 1/08

[52] U.S. Cl. ..... 75/3; 75/4

[58] Field of Search ..... 75/3–5

[56] References Cited

U.S. PATENT DOCUMENTS

| | | | |
|---|---|---|---|
| 3,307,927 | 3/1967 | Muschenborn | 44/19 |
| 3,418,237 | 12/1968 | Booth | 75/3 |
| 3,585,025 | 6/1971 | Obst et al. | 75/3 |
| 3,644,113 | 2/1972 | Lang | 75/3 |
| 3,765,869 | 10/1973 | Schierloh | 75/3 |
| 3,823,009 | 7/1974 | Lailach | 75/3 |
| 3,860,414 | 1/1975 | Lang | 75/3 |
| 3,893,847 | 7/1975 | Derrick | 75/3 |
| 3,898,076 | 8/1975 | Ranke | 75/3 |
| 4,004,918 | 1/1977 | Fukuoka | 75/11 |
| 4,199,348 | 4/1980 | Ground | 75/3 |
| 4,452,940 | 6/1984 | Chu et al. | 524/801 |
| 4,597,797 | 7/1986 | Roorda et al. | 106/194 |

FOREIGN PATENT DOCUMENTS

| | | | |
|---|---|---|---|
| 0533975 | 12/1956 | Canada . | |
| 0890342 | 1/1972 | Canada | 53/13 |
| 265133 | 6/1970 | U.S.S.R. . | |
| 277808 | 8/1970 | U.S.S.R. . | |
| 648626 | 2/1979 | U.S.S.R. . | |
| 662021 | 5/1979 | U.S.S.R. . | |
| 901313 | 1/1982 | U.S.S.R. . | |
| 954464 | 8/1982 | U.S.S.R. . | |
| 996485 | 1/1983 | U.S.S.R. . | |
| 1063850 | 12/1983 | U.S.S.R. . | |

OTHER PUBLICATIONS

Kramer, 29th An. Min. Symp. (1968) 145:51.

Armstrong, Aus. I.M.M. Conf. (1973) 543:6.

Dokuchayev, et al., "Utilization of Surface-Active Agents in Pelletization of Iron Ore Concentrates", Metallurgy and Mining Institute, *Bulletin of Scientific and Technical Information,* Production of Sbornik, No. 3, pp. 5–8 (1972) (English translation).

Bereschnoy et al., *Pelletizing Fine Grained Iron Ore Concentrates,* Moscow, Nedra Publishers (1971).

Pozihidayeva et al., "Selection of a Binder Additive for the Manufacture of Pellets", Izvestiya VUZ-ov. *Ferrous Metallurgy* No. 2, pp. 13–15 (1984); (English translation).

*Primary Examiner*—Peter D. Rosenberg

*Attorney, Agent, or Firm*—Henry H. Gibson

[57] ABSTRACT

This invention is a method for agglomerating mineral ore concentrate comprising the commingling of mineral ore concentrate with a binding amount of water soluble polymers, preferably poly(acrylamides), and clay, preferably bentonite. The polymer is applied to the mineral ore concentrate either (1) as a dispersion in a non-aqueous dispersion medium or (2) as a dry powder. This invention is also a method of agglomerating mineral ore concentrate with flux material.

66 Claims, No Drawings

PROCESS FOR AGGLOMERATING ORE CONCENTRATE UTILIZING CLAY AND DISPERSIONS OF POLYMER BINDERS OR DRY POLYMER BINDERS

This application is a continuation-in part application of U.S. Ser. No. 903,968, filed Sept. 5, 1986, which was a continuation-in-part application of U.S. Ser. No. 736,237, filed May 21, 1985, now abandoned. This application is also a continuation-in-part application of U.S. Ser. No. 875,250, filed June 17, 1986, which was a continuation of U.S. Ser. No. 773,700, filed Sept. 9, 1985, now abandoned.

BACKGROUND OF THE INVENTION

1. Field of the Invention

This invention relates generally to methods for agglomerating or pelletizing mineral ore concentrate. More specifically, this invention relates to methods for agglomerating or pelletizing mineral ore concentrate using water soluble polymers as a dispersion in oil including a water-in-oil emulsion, or as a dry powder. The process of this invention may be used to make conventional pellets, known as acid pellets, or to make flux pellets.

2. Description of the Prior Art

It is customary in the mining industry to agglomerate or pelletize finely ground mineral ore concentrate so as to further facilitate the handling and shipping of the ore. Mineral ore concentrates can include iron oxides, copper oxides, barytes, lead and zinc sulfides, and nickel sulfides. Agglomerates of coal dust and nonmetallic minerals used to make brick or ceramics are also formed. Finished agglomerate forms can include pellets, briquettes, and sinters.

Methods of pelletizing mineral ore concentrate are frequently used in mining operations where the ore is a low grade iron ore, although it may also be utilized with high grade ore. Examples of low grade iron ores are taconite, hematite, and magnetite. Numerous other low grade ores exist wherein pelletizing of the ground particles is beneficial to the handling and shipment of the mineral ore. After the mineral ore has been mined, it is frequently ground and screened to remove large particles which are recycled for further grinding. Typically, an ore is passed through a 100 mesh (0.149 mm) screen. The screened mineral ore is known as a "concentrate". The concentrate may be further processed by flotation to remove up to about 1.5% weight additional silica.

For example, taconite mineral ore concentrate after grinding and screening has an average moisture content of between about 6 to about 11 percent. The moisture content of the mineral ore concentrate can be selectively altered. The moisture content affects the strength of the balls that are formed later in the process and the kinetics of balling as well as the BTUs required to fire them to pellets.

After screening, the mineral ore concentrate is transported on a first conveyor means to a balling drum, balling disc, or another means for balling mineral ore concentrate. Prior to entering the balling means, a binding agent is applied or mixed into the mineral ore concentrate. Commingling the binding agent with the mineral ore concentrate occurs both on the conveyor means and in the means for balling. The binding agent holds the mineral ore concentrate together as balls until they are fired.

Balling drums are apparatus comprising long cylindrical drums which are inclined and rotated. The mineral ore concentrate is simultaneously rotated about the balling drum's circumference and rolled in a downward direction through the drum. In this manner, the mineral ore concentrate is rolled and tumbled together to form roughly spherical-shaped balls. As the balls grow in size and weight they travel down the incline of the drum and pass through the exit of the drum at which point they are dropped onto one or more conveyor means which transports them to a kiln for firing. Inside the balling drum, different factors influence the mechanisms of union of the mineral ore concentrate. These factors include the moisture content of the ore, the shape and size of the mineral ore particles, and the distribution of concentrate particles by size. Other properties of the mineral ore concentrate that influence the balling operation include the mineral ore's wettability and chemical characteristics. The characteristics of the equipment used, such as its size, speed of rotation and angle of the drum with respect to the horizontal plane, can each effect the efficiency of the balling operation. The nature and quantity of the agglomerating or binding agent used in the concentrate is also a factor that determines part of the efficiency of the balling operation.

The formation of agglomerates begins with the interfacial forces which have a cohesive effect between particles of mineral ore concentrate. These include capillary forces developed in liquid ridges among the particle surfaces. Numerous particles adhere to one another and form small balls. The continued rolling of the small balls within the balling apparatus causes more particles to come into contact with one another and adhere to each other by means of the capillary tension and compressive stress. These forces cause the union of particles in small balls to grow in much the same manner as a snowball grows as it is rolled.

After the balling drum operation, the balls are formed, but they are still wet. These balls are commonly known as "green balls" though taconite balls, for example, are usually black in color. Green balls usually have a density of about 130 lb/ft$^3$ in sizes between about $\frac{1}{2}$ inch and about $\frac{3}{8}$ of an inch. The green balls are transported to a kiln and heated in stages to an end temperature of approximately 2800° F. After oxidation, fired green balls are denoted as "pellets" and are extremely hard and resist cracking upon being dropped and resist crushing when compressed.

Two standard tests are used to measure the strength of both green balls and pellets. These tests are the "drop" test and the "compression" test. The drop test requires dropping a random sampling of pellets or balls a distance, usually about 18 inches or less, a number of times until the pellets or balls crack. The number of drops to crack each pellet or ball is recorded and averaged. Compression strength is measured by compressing or applying pressure to a random sampling of pellets or balls until the pellet or ball crumbles. The pounds of force required to crush the pellets or balls is recorded and averaged. The drop and compressive test measurements are important because balls, proceeding through the balling apparatus and subsequent conveyor belts, experience frequent drops as well as compressive forces from the weight of others travelling on top of them. Additionally, pellets are also transported by conveyor and are deposited into rail cars and ship holds so that they too require stringent physical characteristics.

The tumble strength of pellets can also be tested. The tumble strength test is designed to measure impact abrasion resistance of pellets. To test tumble strength, equal weight samples of a selected size of pellets, such as ½ inch pellets, are rotated in a drum at a standard speed for equal amounts of time. The samples of pellets are then removed from the drums and sized on a ¼ inch screen. The amount of small particles and fines that pass through the screen is compared between samples. High percentages of fines indicate that, during shipment, the pellets can be expected to deteriorate. A high rate of deterioration during shipment results in higher costs in smelting the pellets and poor blast furnace performance. Tumble test results are also used to calculate a "Q index" i.e., "Quality"-index. The Q-index was derived by the American Society for Testing and Materials (ASTM) and is described in the ASTM publication E279-65T. A high Q-index such as a value of about 94 or greater is an indication that the pellets are impact and abrasion resistant. Alternately, a %-¼ inch "after tumble test" can be measured and used as a measure of both pellet impact and abrasion resistance.

Thermal shock resistance is another factor which must be taken into consideration in any process for agglomerating mineral ore concentrate. Increases in a ball's thermal shock resistance improve that ball's ability to resist internal pressures created by the sudden evaporation of water when the ball is heated in a kiln. If the ball has numerous pores through which the water vapor can escape or if the rate of water movement to the surface of the balls is enhanced, then thermal shock resistance is improved. If the surface of the ball is smooth, continuous and without pores, or the rate of water movement is too slow, then the ball has an increased tendency to shatter upon rapid heating. This causes a concurrent increase in the amount of "fines" or coarse particles in the pelletized mineral ore. A binder which increases the porosity of balls or which accelerates rate of water movement to the surface improves that ball's ability to resist thermal shock.

Both the binder agent and balling apparatus used to form balls from a mineral ore concentrate can affect the ball size distribution obtained during the balling operation. It is desirable to form balls having a diameter of approximately ½ inch. It is also desirable to have a low variation between the diameter sizes of the balls formed during a balling operation. Pellets having a diameter of more than about ½ inch are less capable of being reduced in a blast furnace because of their increased surface area. Pellets having a diameter of about ½ inch are easily reduced in a furnace and result in fuel efficiency in the operation of the furnace as compared to reducing pellets of larger diameters. Pellets having a size distribution averaging less than ⅜ inch have an increased resistance to gas flow within a furnace. The increased resistance to gas flow decreases furnace productivity and adversely affects the fuel rate consumption of the furnace during operation. Desirable permeability of pellets to gas flow within a furnace is obtained when the pellets are reasonably large, evenly sized, have an approximately even distribution of surface area and provide sufficient porosity. An even distribution of surface area is best obtained starting with spherical balls a compared to balls which vary in their geometrical shapes. The optimum pellet size for furnace operations is between about ⅜ inch and about ½ inch in diameter.

Bentonite (montmorillonite) clay is used as a binding agent in the pelletizing operations for mineral ore concentrate such as taconite ore concentrate. Bentonite produces a high strength ball and pellet having acceptable drop strengths, compressive strengths, and a ball having acceptable thermal shock resistance. Bentonite also provides moisture control in the formation of balls made from mineral ore concentrate. Moisture control in the formation of balls is important because the rate of growth of balls increases with increased moisture. This increase in the rate of growth of the balls is due to the increased efficiency of the agglomerate adhesion. Commercially available bentonite has a typical layer structure, a high particle surface area, and a specific affinity for water. Bentonite's ability to act as a binding agent in balling operations for mineral ore concentrates is believed to result from the immobilization of water contained in a mineral ore concentrate. Bentonite is believed to immobilize water in the mineral ore concentrate by absorbing free water into the surface layers of the bentonite clay. The addition of bentonite to a mineral ore concentrate decreases the water available for participating in the balling of the mineral ore concentrate which leads to a desirable retardation in the pellet growth process during the balling operation.

Bentonite has the disadvantage of increasing the silica content of the pellets that are ultimately formed. Bentonite is converted to silica when balls containing bentonite are fired at about 2400° F. or higher. Bentonite also imparts a significant concentration of acidic components to the pellets. Silica decreases the efficiency of blast furnace operations used in smelting of the ore. For this reason bentonite requires a higher energy expenditure than do organic binders in the blast furnace.

The presence of silica and alkalis in pellets of mineral ore concentrate also affects the hot metal quality and furnace operating efficiency during steel production. For these reasons, rigid specifications exist for the presence of these contaminates in pellets of mineral ore concentrates and it is desirable to keep the presence of these contaminates in pellets as low as possible. Specifically, silica separates from the mineral ore in the cohesive zone to form slag. The addition of a 1% concentration of bentonite or 24.4 lbs./tonne provide an undesirable 0.85% silica or silicon dioxide ($SiO_2$) and alumina or aluminum oxide ($Al_2O_3$). This concentration of silica and alumina decreases the iron content of a pellet about 0.6%. Additionally, the quantity of slag is undesirably higher with this concentration of bentonite. An increased quantity of slag within the furnace decreases the productivity and fuel rate consumption of the furnace during the smelting operation. The increase in slag during the smelting operation resulting from the presence of bentonite in the mineral ore concentrate pellets also affects hot metal sulfur control. Other disadvantages of the presence of bentonite in pellets include an increased shipping expense because of the additional weight added to the pellets by bentonite, and an increase in the requirement for limestone and coke during the smelting operation. The additional limestone and coke used during the smelting operation increases costs and reduces the amount of iron ore that can be converted to iron at a constant volume within the blast furnace.

The use of bentonite to form balls of a mineral ore concentrate also adds alkalis which are oxides of sodium, potassium, and zinc. These alkalis are reduced in the stack zone of a blast furnace, descend into the blast furnace and are vaporized and recirculated in the stack zone. The phenomenon occurs with alkalis because of the low boiling points of these metals. The presence of alkalis in the blast furnace causes both the pellets and coke to deteriorate and form scabs on the furnace wall which increase the fuel consumption rate and decrease the productivity of the smelting operation. The decrease of productivity of the smelting operation results from a decrease in the gas permeability of the pellets. When the scabs become too large to adhere to the walls of the blast furnace, the scabs fall from the walls and cause a burning of tuyeres, a cooling of the hot metal, and a disruption of the smelting operation. The disruption of the smelting operation can result in quality control problems during the production of steel, as well as in safety problems. An additional safety problem that occurs with the use of high concentrations of bentonite in the formation of pellets is an increased exposure to asbestos. Bentonite contains asbestos which can be carried through the process to plant effluent water.

Other binding agents have proven to be useful as binders besides bentonite. These agents or "ore binding polymers" include organic binders such as poly(acrylamide), polymethacrylamide, carboxymethyl cellulose, hydroxyethyl cellulose, carboxyhydroxyethyl cellulose, poly(ethylene oxide), guar gum, and others. The use of organic binders in mineral ore balling operations is desirable over the use of bentonite because organic binders do not increase the silica content of the bound material and they improve the thermal shock resistance of the balls. Organic binders burn out during ball firing operations and cause an increase in the porosity of the pellets. Firing conditions can be modified to improve the mechanical properties of pellets for organic binder systems.

Some organic binders used in mineral ore balling operations are dissolved in an aqueous solution which is sprayed onto the mineral ore concentrate prior to entering the balling drums or other balling means. This application of an aqueous solution increases the moisture content above the natural or inherent moisture content of the mineral ore concentrate which requires a greater energy expenditure during the firing operation of the balls. This increased moisture content also causes an increased likelihood of shattering due to inadequate thermal shock resistance during firing. Ball formation is improved with the use of organic binders, but the drop strength and compression strength of the ball and pellet are frequently below that desired or achieved with bentonite.

Other binders commonly used for agglomerating mineral ore concentrate include a mixture of bentonite, clay and a soap, Portland cement, sodium silicate, and a mixture of an alkali salt of carboxymethylcellulose and an alkali metal salt. The agglomerates made from these binding agents frequently encounter the problems described above of insufficient ball strength or insufficient porosity for the rapid release of steam during induration with heat. Additionally, these binding agents are usually applied to a mineral ore concentrate in aqueous carrier solutions which increase both the amount of energy required to fire the balls and the incidence of shattering due to inadequate thermal shock resistance.

U.S. Pat. No. 3,893,847 to Derrick discloses a binder and method for agglomerating mineral ore concentrate. The binder used is a high molecular weight, substantially straight chain water soluble polymer. This polymer is used in an aqueous solution. The polymers disclosed as useful with the Derrick invention include copolymers of acrylamide as well as other polymers. The Derrick invention claims the use of polymers in an "aqueous" solution. The use of water as a carrier solution for the binding agents increases the moisture of the agglomerate or balls that are formed. The higher moisture content increases the energy required to fire the balls and can increase the rate of destruction of the balls during induration due to the rapid release of steam through the agglomerate.

The use of organic polymers, regardless of the molecular weight of the organic polymers or the form in which they are applied to a mineral ore concentrate, can result in formation of balls having dissimilar geometric shapes. The application of organic polymers in solution, water-in-oil emulsion, and dry powder forms in conjunction with inorganic salts such as sodium carbonate have resulted in the formation of non-spherical balls. The formation of non-uniform, non-spherical balls results in a greater variation in the surface area of the balls and therefore, the pellets, which results in undesirable high levels of fines being generated during formation of pellets and moreover, uneven reduction of the pellets in the furnace during the smelting operation. Higher levels of fines are also generated when small portions of roughened ball or pellet surface are abraded during transport which then produce undesirable dust within the furnace and a the blast furnace.

The non-uniform, non-spherical formation of balls resulting from the use of organic polymer binding systems and inorganic salts results from an undesirable alteration in the ball growth process due to the presence of the inorganic salt and its interaction with surface moisture. Moisture control is important because the rate of ball growth increases with increased moisture.

Two articles by Clum et al. entitled, "Possible Binders for Pelletizing of Magnetic Taconite Concentrates", Mining Engineering 30 (1) page 53, 1978, and "Substitutes For Western Bentonite In Magnetic Taconite Pellets", Society of Mining Engineers of AIME, preprint 76-B-11, 1976, relate to balls of magnetite concentrate using binders of: Wisconsin clay, hydroxyethyl cellulose, poly(ethylene oxide), and a guar gum derivative. The binder systems used in the pelletizing operations of these articles are undesirable because the binder systems utilize an undesirably high concentration of polymer. Additionally, the distinct components result in increased manufacturing difficulties, expenses of manufacturing, and decreased predictability in the performance of the binder system with various mineral ore concentrates. The decrease in predictability of the binder system with various mineral ore concentrates results from the increased complexity of the binder system resulting from the introduction of additional components to the balling operation. The high concentration of polymer in the binder system used in these articles results in an increased cost that can make using these articles undesirable over other commercially available binder systems.

Organic polymers have been used as bentonite extenders wherein the polymers themselves do not significantly add to the strength of the resulting pellets. Additionally, various synthetic and natural resins and modified resins have been used in conjunction with bentonite to pelletize mineral ores. As disclosed in an article by Das Gupta et al., "Additives To Increase Bentonite Effectiveness In Iron Ore Pelletizing", Society of Mining Engineers of AIME, preprint 78-B-97 at page 1, the use of polymers with bentonite has resulted in less than desirable (1) ball formation or (2) pellet reducibility and behavior in a blast furnace. Additionally, this article reports undesirable economic factors resulting from high concentration of the resins required to effectively ball a mineral ore concentrate.

The industry is lacking a method for agglomerating mineral ore concentrate utilizing a two component low moisture polymer binder system, wherein moisture control is provided during ball formation and wherein the balls and pellets formed from the mineral ore concentrate have high mechanical strength properties.

SUMMARY OF THE INVENTION

This invention is a method for agglomerating a particulate material such as a mineral ore concentrate comprising the commingling of the particulate material with two essential components. The two essential components include a first component and a second component of a binder system. The first component of the binder system is a binding amount of water soluble, ore binding polymers. The polymers are adapted to be selectively usable in at least one of either of two conditions of use. In a first condition of use the polymers are applied to the particulate material as a dry powder. In a second condition of use the polymers are applied to the mineral ore concentrate as a dispersion in a non-aqueous dispersion medium, that is for example in one or more of the following forms: (i) a water-in-oil emulsion in which the polymer is contained in water droplets which are dispersed in an oil medium, or (ii) a dispersion of fine polymer particles in oil such as may be made by removing water from a water-in-oil emulsion or by methods described in U.S. Pat. No. 4,325,861 of Braun and Rosen. The second component of the binder system is a clay. The clay is applied to the particulate material to obtain a concentration of up to about 12 pounds per tonne in order to obtain a conventional acid pellet or higher to obtain a conventional flux pellet.

This invention is also a method for agglomerating a particulate material such as a mineral ore concentrate comprising the commingling of the particulate material with three essential components. The first two components are the ore binding polymers and the clay set forth above. The ore binding polymers may also be applied as set forth above. The third essential component is an inorganic material which tends to reduce the acidity of the resulting agglomerate. This component is known as a flux material. When using flux materials, the clay component may be used up to about 25 lb/tonne.

"Oil" is used broadly in this context to include any vehicle, preferably an organic vehicle, which is a non-solvent for the polymer. The size of the fine polymer particles is preferably such that, in the selected dispersion medium, they either resist settling and stratification, or if they have a tendency to settle or stratify, they are easily redispersed before addition to the mineral ore concentrate. The size of the dispersed fine polymer particles required for such stability will therefore depend on the characteristics of the selected dispersion medium, particularly its density and viscosity.

DETAILED DESCRIPTION OF THE INVENTION

This invention is a method for agglomerating particulate material such as a mineral ore concentrate with a two component binder system. The first component of the binder system is one or more water soluble, ore binding polymers in an amount sufficient to bind the particulate material. The polymers are applied to the particulate material in at least one of the following systems: a water in-oil emulsion system, a dispersion-in-oil system, other non-aqueous medium system, or a dry powder system. The second component of the binder system is a clay which is desirably bentonite. The bentonite or other clay is applied to the particulate material as a powder to obtain a concentration in the particulate material of up to about 12 pounds per tonne in order to obtain a conventional acidic pellet. The polymers, clay, and particulate material composition can be commingled in any sequence. The commingled composition then enters a standard means for balling such as a balling disc or drum. The means for balling further commingles the ingredients to form wet or "green" balls. The balls are then transferred or conveyed to a furnace or kiln where they are indurated by heat at temperatures above about 1800° F. and more preferably at about 2800° F. After induration, the balls are known as "pellets" and are ready for shipping or further processing in a smelting operation such as a blast furnace.

The process of this invention may also be used to make flux pellets as opposed to conventional acid pellets. These pellets are made by adding to the taconite concentrate an inorganic material that tends to reduce the acidity of the resulting pellets. When making flux pellets, clay can be added in higher amounts (from about 10 to about 25 lb/tonne). It is clear, therefore, that these levels are far less than the 30–33 lb/tonne which was commonly previously required in a flux system. The inorganic material used in its flux system may be one or more of the following: dolomite ($(Ca,Mg)CO_3$), high calcium dolomite (also known as limestone or calcium carbonate) and magnesium carbonate, or their equivalents. One such equivalent is "olivine", also known as chrysolite $(Mg,Fe)_2SiO_4$. A complete series of olivine exists from $Fe_2SiO_4$ to $Mg_2SiO_4$. These materials may be added prior to, simultaneously with, or after the addition of the polymer to the particulate material. Flux pellets are sometimes described in terms of their basicity—the ratio of bases to acids defined as the ratio of weight % $(CaO+MgO)/(SiO_2+Al_2O_3)$. When basicity is measured, flux pellets ideally have a basicity ratio of about 1.0 to 1.1 and commonly have a basicity ratio of about 0.6, or lower. Typical non-flux or "acid" pellets have a basicity ratio of about 0.2.

Suitable polymers useful as the first component of the binder system of this invention can include water soluble homopolymers, copolymers, terpolymers, and tetrapolymers. In a water-in-oil emulsion system and some dispersion in oil systems the selected polymer is produced by polymerizing its monomeric water-in-oil emulsion precursor. Suitable polymers can be anionic, amphoteric, or non-ionic. In this invention, synthetic and natural polymers of high or low molecular weights, as characterized by their intrinsic viscosities, can be used. This invention is not limited to polymers of a particular intrinsic viscosity. Other useful polymers which are suitable for binding particulate materials such as mineral ore concentrates include polysaccharides, the most desirable of which are members selected from the group consisting of carboxymethyl cellulose, guar gum, hydroxyethyl cellulose and mixtures of these. Still other polymers suitable for use in this invention include poly(ethylene oxide) and poly(acrylic acid). These polymers and others act as binders or binding polymers for particulate materials and especially mineral ore concentrates. The concentrations of these polymers that are sufficient to bind particulate materials vary among the polymers.

Polymers suitable for use with this invention must provide a binding activity to a particulate material and be capable of being used in at least one of two delivery systems. Binding activity is believed to result from the attachment to the surfaces of the clay and/or the surfaces of the concentrate. The delivery systems are either a dispersion in a non-aqueous dispersion medium system (for example, a water-in-oil emulsion system wherein the polymer is within the water which is itself suspended in oil, or a simple polymer dispersion-in-oil system) or a dry powder system. Binding polymers suitable for use in this invention are particularly desirable when they are of a high molecular weight. The particular molecular weight of a polymer is not limiting upon this invention.

Useful measurements of a polymer's average molecular weight are determined by either the polymer's intrinsic viscosity or reduced viscosity. In general, polymers of high intrinsic viscosity or high reduced viscosity have a high molecular weight. An intrinsic viscosity is a more accurate determination of a polymer's average molecular weight than is a reduced viscosity measurement. A polymer's ability to form pellets of mineral ore concentrate is increased as the polymer's intrinsic viscosity or "reduced viscosity" is increased. The most desirable polymers used in the process of this invention have an intrinsic viscosity of from about 0.5 to about 40, preferably from about 2 to about 35 and most preferably from about 4 to about 30 dl/g as measured in a one normal (N) aqueous sodium chloride solution at 25° C.

Water soluble polymers include, among others, poly(acrylamide) based polymers and those polymers which polymerize upon addition of vinyl or acrylic monomers in solution with a free radical. Typically, such polymers have ionic functional groups such as carboxyl, sulfamide, or quaternary ammonium groups. Suitable polymers can be derived from ethylenically unsaturated monomers including acrylamide, acrylic acid, and methylacrylamide. Alkali metal or ammonium salts of these polymers can also be useful.

Desirable polymers for use in this invention are preferably of the following general formula:

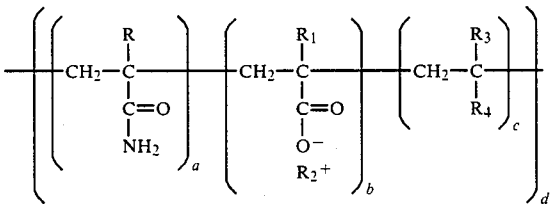

wherein R, $R_1$ and $R_3$ are independently hydrogen or methyl, $R_2^+$ is an alkali metal ion, such as $Na^+$, $K^+$ or an equivalent cation such as $NH_4^+$, $R_4$ is either (1) $—OR_5$ wherein $R_5$ is an alkyl group having up to 5 carbon atoms;

(2)

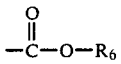

wherein $R_6$ is an alkyl group having up to 8 carbon atoms;

(3)

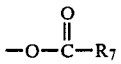

wherein $R_7$ is either methyl or ethyl;

(4) phenyl;

(5) substituted phenyl;

(6) —CN; or (7)

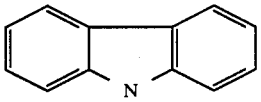

and wherein (a) is from 0 to about 90, preferably from about 30 to about 60 percent, (b) is from 0 to about 90, preferably from about 30 to about 60 percent, (c) is from about 0 to about 20 with the proviso that (a)+(b)+(c) equal 100 percent, and (d) is an integer of from about 1,000 to about 500,000.

Under certain conditions, the alkoxy or acryloxy groups in the polymer can be partially hydrolyzed to the corresponding alcohol group and yield a tetrapolymer of the following general formula:

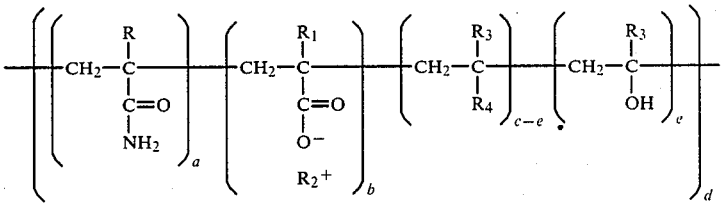

wherein R, $R_1$, $R_2^+$, a, b, and d are as previously defined, $R_4$ is $—OR_5$ or

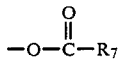

wherein $R_5$ and $R_7$ are as defined previously c is from about 0.2 to about 20 percent, and e is from about 0.1 to less than about 20 percent.

The preferred copolymers are of the following formula:

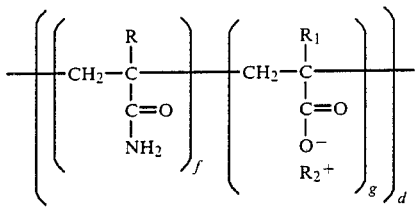

wherein $R_2^+$ is an alkali metal ion, such as $Na^+$, or $K^+$ or an equivalent cation such as $NH_4^+$, and f is from 5 to about 90 preferably from about 30 to about 60 percent, g is from 5 to about 90, preferably from about 30 to about 60 percent with the proviso that (f)+(g) equal 100 percent, and (d) is an integer of from about 1,000 to about 500,000.

The preferred terpolymers are of the following formula:

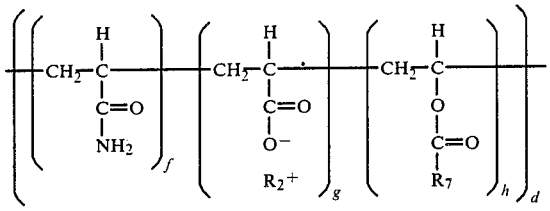

wherein $R_2^+$ is $Na^+$, $K^+$ or an equivalent cation such as $NH_4^+$, $R_7$ is methyl, ethyl, or butyl and f is from about 5 to about 90, preferably from about 30 to about 60 percent, g is from about 5 to 90, preferably from about 30 to 60 percent, h is from about 0.2 to about 20, with the proviso that (f)+(g)+(h) equal 100 percent and d is as previously defined.

The preferred tetrapolymers are of the following formula:

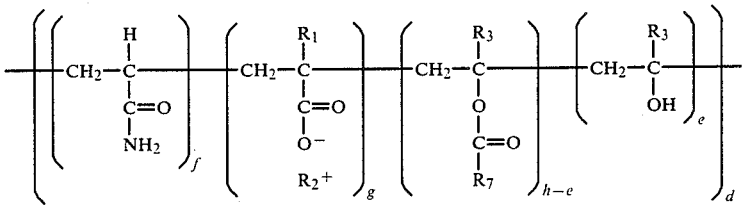

wherein $R_1$, $R_2^+$, $R_3$, $R_7$, f, g, h, d, and e are as previously defined.

Other desirable water soluble polymers for use with this invention include those derived from homopolymerization and interpolymerization of one or more of the following water soluble monomers: acrylic and methacrylic acid; acrylic and methacrylic acid salts of the formula

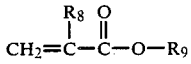

wherein $R_8$ is a hydrogen atom or a methyl group and $R_9$ is a hydrogen atom, an alkali metal atom (e.g., sodium, potassium), an ammonium group, an organoammonium group of the formula $(R_{10})(R_{11})(R_{12})$ $NH^+$ (where $R_{10}$, $R_{11}$ and $R_{12}$ are independently selected from a hydrogen atom, and an alkyl group having from 1 to 18 carbon atoms (it may be necessary to control the number and length of long- chain alkyl groups to assure that the monomer is water soluble), such as 1 to 3 carbon atoms, an aryl group, such as a benzyl group, or a hydroxyalkyl group having from 1 to 3 carbon atoms, such as triethanolamine, or mixtures thereof; acrylamide and methacrylamide and derivatives including acrylamido- and methacrylamido monomers of the formula:

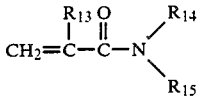

wherein $R_{13}$ is a hydrogen atom or a methyl group; wherein $R_{14}$ is a hydrogen atom, a methyl group or an ethyl group; wherein $R_{15}$ is a hydrogen atom, a methyl group, an ethyl group or $—R_{16}—SO_3X$, wherein $R_{16}$ is a divalent hydrocarbon group alkylene, phenylene, or cycloalkylene having from 1 to 13 carbon atoms, preferably an alkylene group having from 2 to 8 carbon atoms, a cycloalkylene group having from 6 to 8 carbon atoms, or phenylene, most preferably

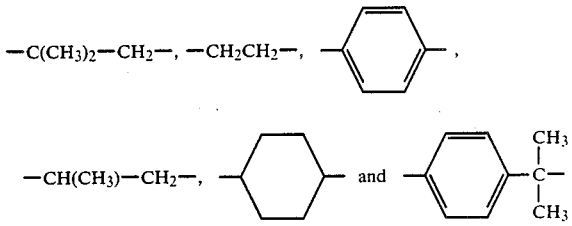

X is a monovalent cation such as a hydrogen atom, an alkali metal atom (e.g., sodium or potassium), an ammonium group, an organo ammonium group of the formula $(R_{17})(R_{18})(R_{19})$ $NH^+$ wherein $R_{17}$, $R_{18}$, $R_{19}$ are independently selected from a hydrogen atom, an alkyl group having from 1 to 18 carbon atoms (it may be necessary to control the number and length of long-chain alkyl groups to assure that the monomer is water soluble) such as 1 to 3 carbon atoms, an aryl group such as a phenyl or benzyl group, or a hydroxyalkyl group having from 1 to 3 carbon atoms such as triethanolamine, or mixture thereof, and the like. Specific examples of water-soluble monomers which can be homopolymerized or interpolymerized and useful in the process of this invention are acrylamido- and methacrylamido-sulfonic acids and sulfonates such as 2-acrylamido-2-methylpropanesulfonic acid (available from the Lubrizol Corporation under its trade name, and hereinafter referred to as, AMPS), sodium AMPS, ammonium AMPS, organo ammonium AMPS. These polymers can be effective binding agents for mineral ore concentrates in about the same concentrations or binding amounts used for the polyacrylamide based polymer binders.

These water soluble monomers can be interpolymerized with a minor amount (i.e., less than about 20 mole percent, preferably less than about 10 mole percent, based on the total monomers fed to the reaction) of one or more hydrophobic vinyl monomers. For example, vinyl monomers of the formula

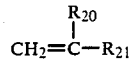

wherein $R_{20}$ is a hydrogen atom or a methyl group and $R_{21}$ is

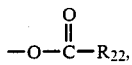

a halogen atom (e.g., chlorine), $—O—R_{23}$,

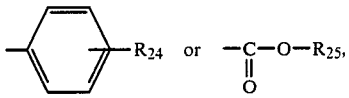

wherein $R_{25}$ is an alkyl group, an aryl group or an aralkyl group having from 1 to 18 carbon atoms, wherein $R_{22}$ is an alkyl group having from 1 to 8 carbon atoms, $R_{23}$ is an alkyl group having from 1 to 6 carbon atoms, preferably 2 to 4 carbon atoms, $R_{24}$ is a hydrogen atom, a methyl group, an ethyl group, or a halogen atom (e.g., chlorine), preferably a hydrogen atom or a methyl group, with the proviso that $R_{20}$ is preferably a hydrogen atom when $R_{22}$ is an alkyl group. Specific examples of suitable copolymerizable hydrophobic vinyl monomers are alkyl esters of acrylic and methacrylic acids such as methyl acrylate, methyl methacrylate, ethyl acrylate, ethyl methacrylate, butyl acrylate, isobutyl acrylate, dodecyl acrylate, 2-ethylhexyl acrylate, etc.; vinyl esters such as vinyl acetate, vinyl propionate, vinyl butyrate, etc.; vinylbenzenes such as styrene, alpha-methyl styrene, vinyl toluene; vinyl ethers such as propyl vinyl ether, butyl vinyl ether, isobutyl vinyl ether, methyl vinyl ether, ethyl vinyl ether, etc.; vinyl halides such as vinyl chloride, vinylidene chloride, etc.; and the like.

The preferred water soluble monomers of these water soluble polymers are acrylamide, AMPS and sodium AMPS, sodium acrylate, and ammonium acrylate. The preferred hydrophobic monomers are vinyl acetate, ethyl acrylate, styrene and methyl methacrylate.

Examples of suitable polymers for use with this invention in water-in-oil emulsions are listed in Table 1. This table provides a representative listing of suitable polymers for use in the water-in-oil emulsions, but does not encompass every suitable polymer or limit the polymers that can be used with this invention.

TABLE 1

| Poly(acrylamide) Emulsions[1] | | | |
|---|---|---|---|
| | | Intrinsic Viscosity | % Solids |
| Anionic Copolymers | Mole % PAM/Na Acrylate | | |
| | 85/15 | 16.2 | 30 |
| | 76/24 | 17.3 | 30 |
| | 59/41 | 20.0 | 30 |
| Nonionic Copolymers | PAM/N—decyl Acrylamide | | |
| | 99/1 | 5.8 | 30 |
| Anionic Terpolymers | PAM/NaA/Vinyl Acetate | | |
| | 54.2/41.1/4.6 | 10.8 | 30 |
| | | 23.0 | 29.5 |
| | 71/24/5 | 20.0 | 30 |
| | 80/15/5 | $RV^2$ = 17.5 | 30 |
| | PAM/NaAMPS/Vinyl Acetate | | |
| | 87/12/1 | 10.0 | 30 |

[1]Abbreviations: PAM: poly(acrylamide); NaA: sodium acrylate; NaAMPS: sodium salt of 2-acrylamido-methyl-propanesulfonic acid.
[2]Reduced viscosity.

A second class of polymers includes those polymers used with this invention in dry powder form. These polymers must be water soluble, but do not necessarily lend themselves to the formation of water-in-oil emulsions. Typically, polymers which form water-in-oil emulsions are also useful with the inventive method as dry powder. Tables 2 and 3 represents listings of polymers which are desirable for use with this invention in powder delivery systems. The powders listed in Table 2 and 3 do not encompass all polymers which can be used as powders in this invention.

TABLE 2

| Poly(acrylamide) Powders | | |
|---|---|---|
| Nonionic | Rhone Poulenc AD-10[1] (intrinsic viscosity 15.4 dl/g) | |
| | BEN-EX ®[2] | |
| | Poly(acrylic acid)[3] | Molecular weight 250,000 |
| | | Approximate mole % PAM/NaA |
| Anionic | Percol ® 725[4] | 89/11 |
| | Percol ® 726 | 77/23 |
| | Superfloc 206[5] | |

[1]AD-10 is a poly(acrylamide) powder sold by Rhone Poulenc, 52 Vanderbilt Avenue, New York, NY.
[2]BEN-EX ® is a non ionic poly(acrylamide) powder sold by then N. L. Baroid Company, P.O. Box 1675, Houston, TX 77001.
[3]This polymer is sold by The Aldrich Company, P.O. Box 355, Milwaukee, WI 53201.
[4]Percol ® products have been analyzed to be copolymers containing the approximate mole % of PAM and NaA given in Table 2 and are sold by Allied Colloids of Fairfield, New Jersey.
[5]Superfloc 206 is an acrylamide and sodium acrylate copolymer sold by The American Cyanamid Company, 1 Cyanamid Plaza, Wayne, N.J. 07470.

TABLE 3

| Miscellaneous Powders | |
|---|---|
| Poly(ethylene oxide)[1] | Molecular weight >100,000 |
| Guar Gum[2] | |
| Carboxymethyl cellulose[3] | |
| Hydroxyethyl cellulose[1] | |

[1]These polymers are sold by numerous manufacturers, including the Union Carbide Corporation, Old Ridgebury Road, Danbury, CT 06817
[2]Guar gum is sold by numerous distributors including The National Starch and Chemical Company, 10-A Finderne Ave., Bridgewater, N.J. 08807.
[3]Carboxymethyl cellulose is sold by numerous distributors including The Hercules Company, 29-T W. 38th St., New York, NY 10018.

A third class of polymers includes those polymers used with this invention in the form of dispersions in oil.

A representative but non-limiting list of polymers useful in this form includes those set forth in Table I.

The second component of the binder system of this invention is a material that can be mixed with the particulate material prior to agglomeration which partially dries the resulting green pellets by absorbing and stabilizing free water or moisture present in the particulate material. Desirably, the second component of the binder system of this invention is a clay. Suitable clays include Wisconsin clay and most desirably bentonite clay. When the second component of the binder system of this invention is clay it is most desirable to use a pure clay. With the increasing scarcity of high quality moisture absorbing clays such as bentonite, clay compositions such as bentonite and an extender or other additive, can be effective for use as the second component in the binder system of this invention.

When the second component of the binder system of this invention is a clay, particularly bentonite, some binding action of the particulate material is provided by the clay. The concentrations of clay used in this invention are always less than would be needed if clay were used alone. If the concentrations of clay used in this invention were used alone, the clay would not contribute significantly to the binding of the particulate material or to its strength in the green state.

Another component of this invention is a self-invertible water in-oil emulsion. The self-invertible water-in oil emulsion system is a suspension of droplets comprised of water soluble, high molecular weight polymers and water in a hydrophobic medium. Examples of suitable emulsion systems and methods to form suitable emulsions are found in U.S. Pat. Nos. 4,485,209 to Fan et al. and 4,452,940 to Rosen et al., each of which is herein incorporated by reference.

Desirable hydrophobic liquids used in these emulsion or dispersion systems are isoparaffinic hydrocarbons. A suitable isoparaffinic hydrocarbon is that sold by the Exxon Corporation known as Isopar® M. Other suitable hydrophobic liquids for use as the external phase in an emulsion system include benzene, xylene, toluene, mineral oils, kerosenes, petroleum, paraffinic hydrocarbons, and mixtures of these.

In desirable embodiments of this invention, which include a polymer binding agent in a water-in oil emulsion, two surfactants are used to form the emulsion. A first surfactant is used to form the water-in-oil emulsion system. After the water in-oil emulsion system is formed, a second surfactant can be added. The second surfactant is a water soluble inverting surfactant which, it is believed, permits the inversion of the water in-oil emulsion to an oil-in-water emulsion upon contact with the inherent or added moisture present in the mineral ore concentrate. Upon inversion of the water-in oil emulsion the polymer is forced out of the internal aqueous phase and made available to the surface of the mineral ore concentrate. This release of the polymer onto the surface of the mineral ore concentrate allows for rapid commingling of the polymer with the mineral ore concentrate. Under certain circumstances, pellet porosity could be improved simply by the presence of an organic binder without the need to interact with surface moisture. Therefore, emulsions that do not contain inverting surfactants, or mixtures of emulsions which do and emulsions which do not contain inverting surfactants, can also be used with this invention. This is believed to especially be true when higher pellets porosity is desired, since a higher dose of organic binder will burn off in the furnace.

The surfactants suitable for use in forming emulsions of one embodiment of this invention are usually oil-soluble having a Hydrophile Lipophile Balance (HLB) value of from about 1 to about 10 and preferably from about 2 to about 6. These surfactants are normally referred to as water-in-oil type surfactants. Suitable surfactants include the acid esters such as sorbitan monolaurate, sorbitan monostearate, sorbitan monooleate, sorbitan trioleate, mono and diglycerides, such as mono and diglycerides obtained from the glycerolysis of edible fats, polyoxyethylenated fatty acid esters, such as polyoxyethylenated (4) sorbitan monostearate, polyoxyethylenated linear alcohol, such as Tergitol 15-S-3 and Tergitol-25 L-3 supplied by the Union Carbide Corporation, polyoxyethylene sorbitol esters, such as polyoxyethylene sorbital beeswax derivative, polyoxyethylenated alcohols such as polyoxyethylenated (2) cetyl ether, and the like.

Water-soluble inverting surfactants which can be used include polyoxyethylene alkyl phenol, polyoxyethylene (10 mole) cetyl ether, poloxyethylene alkylaryl ether, quaternary ammonium derivatives, potassium oleate, N-cetyl N-ethyl morpholinium ethosulfate, sodium lauryl sulfate, condensation products of higher fatty alcohols with ethylene oxide, such as the reaction product of oleyl alcohol with 10 ethylene oxide units; condensation products of alkylphenols and ethylene oxide, such as the reaction products of isooctylphenol with 12 ethylene oxide units; condensation products of higher fatty acid amines with five, or more, ethylene oxide units; ethylene oxide condensation products of polyhydric alcohol partial higher fatty esters, and their inner anhydrides (mannitolanhydride, called Mannitan, and sorbitol-anhydride, called Sorbitan). The preferred surfactants are ethoxylated nonyl phenols, ethoxylated nonyl phenol formaldehyde resins, and the like.

The inverting surfactant is used in amounts of from about 0.1 to about 20, preferably from about 1 to about 10 parts per one hundred parts of the polymer.

The mixture of both the aqueous phase and the oil phase of the emulsions used in this invention can contain about 20 to about 50 and preferably from about 22 to about 42 percent weight of the hydrophobic liquid and the hydrophobic monomers, based upon the total weight of the composition.

The aqueous solution used to form the emulsion systems of this invention can contain a mixture of water soluble monomers. These monomers have a water solubility of at least 5 weight percent and include acrylamide, methacrylamide, acrylic acid, methacrylic acid, and their alkali metal salts, aminoalkyl acrylate, aminoalkyl methacrylate, dialkylaminoalkyl acrylate, dialkylamino methacrylate and their quaternized salts with dimethyl sulfate or methyl chloride, vinyl benzyl dimethyl ammonium chloride, alkali metal and ammonium salts of 2-sulfoethylacrylate, alkali metal and ammonium salts of vinyl benzyl sulfonates, maleic anhydride, 2-acrylamide-2-methylpropanesulfonic acid, and the like. The preferred monomers are acrylamide, acrylic acid, and sodium salt of 2-acrylamido-methylpropanesulfonic acid.

If acrylic acid is used as a monomer it is reacted with a base, preferably with an equivalent amount of base, such as sodium hydroxide, so that the sodium acrylate solution has a pH of from about 5.0 to about 10.0, preferably from about 6.5 to about 8.5, depending on the type and amount of base employed. This solution is combined with another water soluble monomer, such as acrylamide, and then with water to form the aqueous phase.

Hydrophobic monomers which can be useful in forming the emulsion systems of this invention include one or more of vinyl esters such as vinyl acetate, alkyl acrylates such as ethylacrylate, alkyl methacrylates such as methacrylate, vinyl ethers such as butylvinyl ether, acrylonitrie, styrene and its derivatives such as alpha-methylstryrene, N-vinyl carbazole, and the like.

Appropriate reactors and catalysts are also used with this invention. These compounds can vary. Examples of suitable reactors and catalysts can be found in the Fan and Rose patents identified above.

Emulsions used in this invention are made by any suitable method. A desirable method for making emulsions is disclosed in U.S. Pat. No. 4,485,209 to Fan. This invention is not limited to a particular emulsion or method for producing an emulsion.

The polymer dispersed in oil systems used in this invention may be a dispersion of fine particles of polymer in oil such as may be made by removing water from water-in-oil emulsions of the kind described above. Dispersions of polymers-in-oil used in this invention may also be dispersions of fine particles of polymers prepared as described for example in U.S. Pat. No. 4,325,861 of Braun and Rosen. Desirable hydrophobic liquids used in these dispersions are the same as the hydrophobic liquids used in water-in-oil emulsions referred to above.

An advantage of using water-in-oil emulsions, or other dispersions in a non-aqueous medium, in the formulation of balls is that the amount of water added to the mineral ore concentrate is greatly reduced from that required to deliver polymers in aqueous solutions, thus resulting in an energy savings upon firing of the balls. Also, the hydrophobic liquid or oil in the inverted water-in oil emulsion system or other non aqueous dispersion is consumed during the firing operation. The burn-out of the oil droplets from the interior of the balls increases the porosity of the pellets in much the same manner as does the burning of the organic binder or polymer from the interior of the balls. This increase in porosity is believed to improve the release of water vapor from the balls and decrease the occurrence of thermal shock upon firing of the balls. Still another advantage of the use of these emulsions is they produce an acceleration in the rate of water movement to the surface of the balls which also improves thermal stock resistance.

An additional benefit realized by the use of a water-in-oil emulsion system, or other dispersions in a non-aqueous medium, to deliver a polymer binder to mineral ore concentrate in pelletizing operations is a decrease in the amount of contact time required for sufficient commingling of the polymer binder with the mineral ore concentrate. The contact time of a polymer after the emulsion, or polymer-in oil dispersion is sprayed onto the mineral ore concentrate need only be sufficient to allow activation of the polymer on the surface of the mineral ore concentrate. The amount of time can vary depending upon the emulsion, or polymer-in-oil dispersion system used and the concentration of the polymer binder within the emulsion, or polymer in-oil dispersion system as well as the total amount of polymer binder sprayed upon the mineral ore concentrate and its moisture content. In desirable embodiments of this invention, sufficient time for commingling of the polymer binder system into the mineral ore concentrate occurs by spraying the water-in-oil emulsion, or polymer in oil dispersion onto the mineral ore concentrate upstream or just upstream of where the concentrate enters the balling apparatus.

Application of a water-in-oil emulsion, or other dispersion in a non aqueous medium at the mineral ore concentrate treatment site can be accomplished by applying the emulsion, or polymer-in-oil dispersion to the mineral ore concentrate through any conventional spraying or dripping apparatus. The clay is sprinkled from a vibrating hopper or other dispersing means onto the mineral ore concentrate and the composition is conveyed towards the balling apparatus. The activation of the polymers onto the surface of the mineral ore concentrate is rapid, and because the polymers are evenly spread or commingled throughout the mineral ore concentrate, the time required for sufficient commingling to initiate ball formation is about one minute or less although the emulsion or polymer-in-oil dispersion may be applied to the mineral concentrate several hours upstream of the balling drum or disc.

This invention also includes the application of binding polymer systems concentrate that are dry powders to mineral ore. In these embodiments the dry powdered polymers are mixed together with the powdered clay or added separately. The resulting powder composition is sprinkled onto the mineral ore concentrate as the concentrate is conveyed towards the balling drum. The vibration of the conveyor means and the action of the balling drum commingles the powders into the mineral ore concentrate. Upon sufficient contact time with the moisture in the mineral ore concentrate, the polymers are adsorbed onto the surface of the concentrate. Suitable contact time can be essentially instantaneous, but is often between about 1 minute to 3 hours or more. Further commingling occurs during the mixing within the balling apparatus. The use of the dry powder polymer embodiments of this invention eliminates the need for spraying equipment where the polymer is delivered as an emulsion or as a water-in oil emulsion or as a polymer-in-oil dispersion.

The useful range of the concentration of the polymer on an active basis is between the 0.001 percent about 0.3 percent based on weight of bone dry concentrate. A desirable range is between about 0.001 percent and about 0.1 percent. These ranges are applicable for both dry, emulsified and polymer-in oil dispersion applications of polymer binder systems. The most desirable concentration of the polymer when applied to a wet mineral ore concentrate is between about 0.005 to about 0.10% weight (about 0.1 to about 2.0 pounds per tonne) of mineral ore concentrate. A wet mineral ore concentrate has between about 8 and about 11 percent water.

In a preferred method of practicing the present invention, the water in oil emulsion contains approximately 30 weight percent of a copolymer (prepared from approximately 50 weight percent acrylamide monomer and 50 weight percent sodium acrylate monomer), 35 weight percent water, 35 weight percent Isopar® M, and a nonyl phenol ethoxylate as a surfactant. Before spraying or dripping onto taconite concentrate, the emulsion may be filtered to remove gels which might clog the delivery device, such as a spray nozzle. The emulsion is added at the rate of about 0.6 pounds per tonne. Bentonite may also be added at the rate of up to about 12 pounds per tonne. Preferably, the bentonite is added after the emulsion and just before the taconite concentrate enters the pelletizing drums or discs. The useful range of the concentration of the polymer on an active basis is between about 0.001 percent to about 0.3 percent based on weight of bone dry concentrate. The preferred range is between about 0.001 percent and about 0.1 percent and most preferred range is between about 0.005 to about 0.10 percent. These ranges are applicable for both dry and dispersed form applications of polymer binders. Should the use of a water soluble inorganic salt be desired, the useful concentration range, based upon the weight of bone dry concentrate, is between about 0.001 percent and about 0.5 percent with the preferred range being between about 0.005 percent and about 0.3 percent. These ranges are useful for both flux and non flux pellets.

The invention is further understood from the examples below, but is not to be limited to the examples. The numbered examples represent the present invention. The lettered examples do not represent this invention and are for comparison purposes. Temperatures given are in ° C. unless otherwise stated. The following designations used in the examples and elsewhere herein have the following meanings:

| ABBREVIATION | DEFINITION |
|---|---|
| AM | acrylamide |
| Apx. | approximate |
| $CaCO_3$ | calcium carbonate |
| $(Ca,Mg)\ CO_3$ | dolomite |
| cc | cubic centimeter |
| CMC | carboxymethylcellulose |
| $CO_2$ | carbon dioxide |
| dl/g | deciliter per gram |
| °F. | degrees fahrenheit |
| gm/cc | grams per cubic centimeter |
| gms | grams |
| HEC | hydroxyethylcellulose |
| IV | intrinsic viscosity |
| lb | pound or pounds |
| lb/tonne | pound or pounds per tonne |
| mm | millimeters |
| NaA | sodium acrylate |
| NaAMPS | sodium salt of 2-acrylamido 2-methylpropanesulfonic acid |
| NaCl | sodium chloride |
| $(NaPO_3)_n$ | sodium metaphosphate where n is 2 or more |
| $Na_2CO_3$ | sodium carbonate |
| $Na_2O$ | sodium oxide |
| PAM | poly(acrylamide) |
| psi | pounds per square inch pressure |
| rpm | revolutions per minute |
| RV | reduced viscosity |
| tonne | metric ton |
| U.S. | United States |
| VA | vinyl acetate |
| wt | weight |
| wt % | weight percent |
| # | number |
| % | percent by weight unless otherwise specified |

LABORATORY EXPERIMENTAL PROCEDURE

In these examples taconite balling consists of a two step procedure. Initially, seed balls are prepared from the taconite ore using bentonite clay as a binder. These seed balls are passed through screens to obtain seed balls of a size that pass through a #4 U.S. mesh screen having a 0.187 inch opening, but not through a #6 U.S. mesh screen having a 0.132 inch opening. The seed balls are then used with additional concentrate and the binder of interest to prepare the larger green balls. Finished green balls are sieved to be in a size range between 13.2 mm to 12.5 mm. This can be accomplished by using USA Sieve Series ASTM-E-11-70. Following sieving, the green balls are tested for wet crushing strength and wet dropping strength. Additional green balls are dried (not fired) and tested for both dry crushing and dry dropping strength. For the examples cited, all testing was done with either wet or dry green balls.

Seed ball formation in these examples is begun with a sample of 900 grams (bone dry weight) of taconite concentrate containing between 8 to 11% moisture. The concentrate is sieved through a 9, 10, or 12 mesh screen and spread evenly over an oil cloth. Next 7.0 grams of bentonite clay is spread evenly over the top of the concentrate and mixed until homogenous. The mixture is incrementally added to a revolving rubber drum having approximately a 16 inch diameter and a 6 inch cross section. The drum is rotated at 64 revolutions per minute. Humidity is not controlled in these examples. Just prior to addition of concentrate, the inside of the drum is wet with water from a spray bottle. While rolling, several handfulls of the bentonite-concentrate mixture is added to the drum. Distilled water is added when the forming agglomerates begin to develop a dull appearance. As seed balls are formed, they are screened to separate and obtain balls which pass through a #4 U.S. mesh screen, but not through a #6 U.S. mesh screen. Captured fines are re-added to the balling drum and oversized seeds are rejected. The procedure of readding captured fines is repeated several times until sufficient seed balls of the desired size have been produced. The seed balls are then rolled for one minute to finish the surface. Formed seed balls can be placed in a sealed container containing a damp cloth so as to retard dehydration of the balls.

Green ball formation in these examples is begun with a sample of 1800 grams (bone dry weight) of mineral ore containing a selected moisture content between 8 to 11% moisture. The concentrate is added into a 12 inch diameter Cincinnati Muller and mixed for 1.0 minute. Thereafter, an amount of binder to be used in the example is uniformly distributed over the surface of the concentrate. In examples using emulsion polymer or polymer-in oil dispersions, such materials are uniformly delivered dropwise from a syringe. For those examples which employ powdered polymers, the powder is dry blended with the clay or added separately and the resulting mixture is then uniformly sprinkled over the concentrate in the Muller. The Muller is then turned on for three minutes to mix the binder with the concentrate. The uniform mixture is then screened through an #8 U.S. mesh screen.

After moistening the inside of the rotating balling drum, about 40 grams of seed balls are added to the tire. Then the concentrate and binder mixture is incrementally fed into the drum over a period of six minutes with intermittent use of distilled water spray. During the initial portion of this process, small amounts of the concentrate and binder mixture are added each time the surface of the balls appear shiny. Typically, the latter portion of the six minute rotating period requires an increased amount of the concentrate and binder mixture when compared to the initial part of the rotating period. Water spray is applied each time the surface of the balls takes on a dull appearance.

After the six minute rotating period is complete, the balling drum is rotated one additional minute to "finish off" the ball surface. No water spray is used during the final one minute period. Following completion of this procedure, the green balls are screened for testing purposes to a size between 13.2 mm and 12.5 mm.

Compression testing in these examples is performed by using a Chatillon Spring Tester of a 25 pound range (Model LTCM - Serial No. 567). Twenty green balls are crushed in the tester within 30 minutes of the completion of balling at a loading rate of 0.1 inches per second. The pounds of force required to crush each ball is averaged for the twenty balls and is herein called the wet crush strength. An additional twenty balls are dried for one hour at 350° F. While these balls are still warm to the touch, the crushing procedure is repeated to obtain the dry crush strength average measured in pounds per square inch (psi).

Drop testing in these examples is performed with twenty green balls which are tested within 30 minutes of their formation. These balls are dropped one at a time from a height of 18 inches onto a steel plate. The number of drops to obtain ball failure is recorded. Ball failure is determined when a crack in a ball of approximately a 0.7 mm or greater occurs. The average for twenty wet ball drops is reported. Twenty additional green balls are dried by the procedure set out for the compression test and then each is dropped from a 3 inch height. The average number of drops to obtain pellet failure for twenty balls is determined and recorded.

The tumble test is used to measure the impact and abrasion resistance of pellets. In this test twenty five pounds of $+\frac{1}{2}$ inch pellets are rotated in a drum at twenty-five revolutions per minute for eight minutes. This sample of pellets is then removed and sized at $\frac{1}{4}$ inch. A high percentage of fines after screening indicates that the pellets will experience undesirably high frequencies of deterioration during shipment. The results of the tumble test are used to calculated the Q-index or is simply expressed as the % of pellets below $\frac{1}{4}$".

The definition of acceptable or target mechanical properties is defined in these examples, within limits of experimental error, by comparing the critical green property as measured by the 18 inch green drop test. Desirable balls have an 18 inch green drop test value at a minimum of about 7 plus or minus about 1. Desirable balls are also spherical and have a moist or dry surface. Undesirable balls have a wet surface. Surface appearance descriptors are shown below.

DRY: Smooth, dull appearing. This result is acceptable.

MOIST: Moderately rough, shiny surface indicating a continuous film of moisture. This result is acceptable.

WET: Irregular shiny surface with shallow peaks and valleys. Sticky to the touch and material is easily transferred to the hand. This result is undesirable.

Balls having wet drop numbers above about 7.0 and wet crush numbers above about 3.0 are useful to the industry. Balls having dry drop numbers greater than about 2.0 and dry crush numbers above about 4 are acceptable to the industry. Comparisons of ball mechanical properties for different binders need to be made at approximately equal ball moisture contents. Wet ball properties are important because wet balls are transported by conveyors and are dropped from one conveyor to another during their movement. Dry properties are important because in kiln operations balls can be stacked 6 to 7 inches high or more. The balls at the bottom of such a pile must be strong enough so as not to be crushed by the weight of the pellets on top of them. Dry balls are also conveyed and must resist breakage upon dropping.

Unless otherwise stated in the following examples, the term, water-in oil emulsion, refers to a water-in-oil emulsion containing an inverting surfactant. In these emulsions the oil phase is Isopar® M. The polymer binding agent PAM/NaA/VA is in a mole ratio of 54.2/41.1/4.6. The mineral ore concentrate is a taconite ore concentrate.

EXAMPLE A

This example illustrates plant trial data wherein bentonite was used alone at a concentration of 15 pound per tonne to form green balls from taconite ore concentrate. The data of this example is provided for comparative purposes as a control for comparison with the examples of the invention. The results of this example are presented in Table 4.

TABLE 4

| System<br>Property | Bentonite Control<br>15 lb/Tonne |
|---|---|
| 18" Green Drop No. | 8.3 |
| Wet Crush, psi | 2.12 |
| Dry Crush, psi | 9.25 |
| Surface Appearance | dry |
| Ball Shape | spherical |

EXAMPLES B AND C AND EXAMPLES 1 AND 2

The experimental procedure described above was used for these examples with the exception that the balls were produced in a full size commercial balling drum facility. In these examples green balls of taconite ore concentrate are formed with a PAM/NaA/VA binding agent in a water-in-oil emulsion. The intrinsic viscosity of the polymer binding agent was 23 dl/g. The results of these examples is set forth in Table 5.

TABLE 5

| Property | Example B<br>PAM/NaA/VA[1]<br>$NA_2CO_3$ | Example C<br>PAM/NaA/VA[2] | Example 1<br>PAM/NaA/VA[3]<br>Bentonite | Example 2<br>PAM/NaA/VA[4]<br>Bentonite |
|---|---|---|---|---|
| 18" Green Drop. No. | 9.3 | 6.8 | 7.4 | 10.3 |
| Wet Crush, psi | 1.64 | — | — | — |
| Dry Crush, psi | 1.75 | 1.35 | 2.20 | 2.82 |
| Surface Appearance | wet | wet | moist | moist |
| % Moisture | 9.5 | — | — | — |

TABLE 5-continued

| Property | Example B PAM/NaA/VA[1] $NA_2CO_3$ | Example C PAM/NaA/VA[2] | Example 1 PAM/NaA/VA[3] Bentonite | Example 2 PAM/NaA/VA[4] Bentonite |
|---|---|---|---|---|
| Ball Shape | irregular | spherical | spherical | spherical |

[1]The dose of the binding agents to the mineral ore concentrate is 0.6 pounds of PAM/NaA/VA emulsion per tonne and 0.8 pounds of $Na_2CO_3$ per tonne delivered as a 15 percent solution.
[2]The dose of the binding agent to the mineral ore concentrate is 0.6 pounds of PAM/NaA/VA emulsion per tonne.
[3]The dose of the binding agent to the mineral ore concentrate is 0.6 pounds of PAM/NaA/VA emulsion per tonne and 4 pounds of bentonite per tonne.
[4]The dose of the bentonite to the mineral ore concentrate is 6 pounds per tonne. This example is provided for comparison only.

These examples demonstrate that the use of a PAM/-NaA/VA emulsion along with low doses of bentonite produce a taconite binder system that provides improved green balls when compared to the polymer binder agent used alone or with $Na_2CO_3$. These examples demonstrate that by terminating the use of $Na_2CO_3$ with a polymer binding agent and substituting a small amount of bentonite the balls formed become spherical and have an acceptably moist appearing surface. Example 1 demonstrates that the 18 inch green drop test values were equivalent (using an experimental error of plus or minus 1) to the bentonite control of Example A.

EXAMPLES D AND E AND EXAMPLES 3 AND 4

The experimental procedure described for Example 1 was also used to produce the balls of these examples. The results of these examples are presented in Table 6.

TABLE 6

| Property | Example D PAM/NaA/VA $NA_2CO_3$[1] | Example E PAM/NaA/VA[2] | Example 3 PAM/NaA/VA Bentonite[3] Test 1 | Example 3 PAM/NaA/VA Bentonite[3] Test 2 | Example 4 Bentonite[4] Test 1 | Example 4 Bentonite[4] Test 2 |
|---|---|---|---|---|---|---|
| 18" Green Drop. No. | 11.5 | 10.3 | 14.9 | 12.5 | 15.0 | 8.3 |
| Wet Crush, psi | 1.82 | — | — | 2.7 | — | 1.88 |
| Dry Crush, psi | 2.00 | 1.92 | 3.18 | 3.10 | 3.67 | 2.83 |
| Surface Appearance | wet | wet | moist | | moist | |
| % Moisture | — | — | — | — | — | 9.7 |
| Ball Shape | irregular | spherical | spherical | | spherical | |

[1]The dose of the binding agents to the mineral ore concentrate is 0.8 pounds of PAM/NaA/VA emulsion per tonne and 0.8 pounds of $Na_2CO_3$ per tonne delivered as a 15 percent solution.
[2]The dose of the binding agent to the mineral ore concentrate is 0.8 pounds of PAM/NaA/VA emulsion per tonne.
[3]The dose of the binding agent to the mineral ore concentrate is 0.8 pounds of PAM/NaA/VA emulsion per tonne and 4 pounds of bentonite per tonne.
[4]The dose of the bentonite to the mineral ore concentrate is 6 pounds per tonne. The difference is 18" green drop is due to differences in the moisture content of the taconite ore concentrate.

These examples are similar to those of Examples B and C and Examples 2 and 3 and use a higher concentration of the polymer binding agent. The resulting green balls of these examples are more desirable than those obtained in Examples B and C and Examples 2 and 3. The balls obtained from Examples 3 and 4 are markedly superior to those of Example A. The value of the green drop test for Example 3 doubled when compared to Example 1. This increase in the green drop test value is the result of increasing the polymer binding agent from 0.6 to 0.8 pounds of emulsion per tonne.

EXAMPLE F AND EXAMPLE 5

The experimental procedure described for Example 1 was used in this example. The dose of the PAM/-NaA/VA to the taconite ore concentrate is 0.6 pounds of emulsion per tonne and 4 pounds of bentonite per tonne. A full size balling drum was uniformly operated for eight hours to provide green balls with the results presented in Table 7.

TABLE 7

| Test No. | Operating Time Hours | 18" Green Drop No. | Wet Crush psi | Dry Crush psi | Surface Appearance | Ball Shape | % Moisture |
|---|---|---|---|---|---|---|---|
| 1 | 2 | 10.3 | 1.62 | 4.13 | moist | spherical | 9.5 |
| 2 | 4 | 11.1 | 1.94 | 4.18 | moist | spherical | 9.6 |
| 3 | 6 | 9.7 | 1.90 | — | moist | spherical | — |
| 4 | 8 | 11.2 | 1.68 | 3.83 | moist | spherical | 9.6 |
| Average: | | 10.6 | 1.79 | 4.05 | moist | spherical | 9.6 |

The pellet data for the eight hour run of the balling drum in this example was not available because the steel sample baskets melted during the test. Pellet data was obtained based on a total plant output (6 balling drums) and comprised pellets made with the PAM/NaA/VA polymer binding agent and bentonite system. Data for a bentonite system is provided for comparative purposes. The data represents results obtained from an 8 hour run using only bentonite followed by a 16 hour run using a polymer binder system of this invention followed by a final 8 hour run using only bentonite. All Q-index values were essentially the same and acceptable. The pellet data is presented in Table 8.

TABLE 8

| | Q-Index | Binder | % −200 Mesh | Fired Compression psi |
|---|---|---|---|---|
| 8 Hours | 93.6 | Bentonite 17 lb/tonne | 4.5 | 421 |
| 16 Hours | 93.5 | | 4.5 | 433 |

TABLE 8-continued

| | Q-Index | Binder | % −200 Mesh | Fired Compression psi |
|---|---|---|---|---|
| | 93.2 | PAM/NaA/VA and Bentonite | 4.3 | 448 |
| 8 Hours | 93.6 | Bentonite 17 lb/tonne | 5.3 | 419 |

EXAMPLE 6

The experimental procedure described for Example 1 was used to prepare and test the samples of green balls for this example. This example was conducted using a full size commercial balling drum. The system was allowed to equilibrate for about 30 minutes prior to taking data and making the next incremental change of the bentonite dose.

The polymer binder agent use in this example was PAM/NaA/VA at a dose of 0.6 pounds per tonne of taconite ore concentrate. Test number 1 of this example contained no bentonite and is presented for comparative purposes only. The data of the green balls obtained in this example are presented in Table 9.

TABLE 9

| Test No. | lb./ Bentonite Tonne | 18" Green Drop. No. | Dry Crush psi | Surface Appearance | Ball Shape |
|---|---|---|---|---|---|
| 1 | 0 | 6.8 | 1.35 | wet | spherical |
| 2 | 1 | 7.5 | 1.70 | wet-moist | spherical |
| 3 | 2 | 7.8 | 2.38 | wet-moist | spherical |
| 4 | 3 | 8.3 | 2.08 | moist | spherical |
| 5 | 4 | 7.4 | 2.20 | moist | spherical |
| 6 | 5 | 9.9 | 2.63 | moist | spherical |
| 7 | 6 | 11.3 | 2.82 | moist | spherical |

This example demonstrates the relative surface drying effect of various low doses of bentonite in green balls. The tests were conducted using 6 pounds of bentonite per tonne of taconite ore concentrate provided the best 18 inch drop test and surface appearance.

EXAMPLE 7

The experimental procedure described for Example 6 was used to prepare and test the green balls of this example. The polymer binding agent of this example was a PAM/NaA/VA polymer at a dose of 0.8 pounds per tonne of taconite ore concentrate. The results of the green balls obtained from this example are presented in Table 10.

TABLE 10

| Test No. | lb. Bentonite/ Tonne | 18" Green Drop No. | Wet Crush psi | Dry Crush psi | Surface Appearance | Ball Shape |
|---|---|---|---|---|---|---|
| 1 | 0 | 10.3 | — | 1.92 | wet | spherical |
| 2 | 2 | 13.3 | — | 2.35 | wet-moist | spherical |
| 3 | 4 | 14.9 | — | 3.18 | moist | spherical |
| 4 | 4 | 12.5 | 2.17 | 3.10 | moist | spherical |
| 5 | 6 | 15.0 | — | 3.67 | moist | spherical |

This example demonstrates that increasing concentrations of bentonite with a polymer binding agent improve green ball physical characteristics. The green balls obtained with a bentonite dose of 6 pounds per tonne provided the best results of this example and produced an excellent ball.

EXAMPLES G, H AND I AND EXAMPLE 8

The laboratory experimental procedure described above was used to prepare and test the samples of green balls of taconite ore concentrate of these examples. The polymer binder in Example 8 was applied as an emulsion. The results of the tests on green balls obtained in these examples are presented in Table 11.

TABLE 11

| | Example G | Example H | Example I | Example 8 |
|---|---|---|---|---|
| | lb PAM/NaA/VA emulsions per tonne | | | |
| | 0 | 0 | 0 | 0.6 |
| | lb Bentonite per tonne | | | |
| Ball Properties | 18 | 0 | 4 | 4 |
| 18" Green Drop. No. | 18.3 | 3.1 | 4.0 | 7.7 |
| Wet Crush, psi | 4.6 | — | 4.7 | 3.9 |
| Dry Drop No. | >30.0 | — | 3.0 | 2.5 |
| Dry Crush, psi | 21.9 | — | 5.6 | 5.5 |
| Surface Appearance | dry, smooth | wet | wet | moist |
| Ball Shape | spherical | spherical | spherical | spherical |
| % Moisture | 9.8 | — | 8.1, 9.5 | 9.7 |
| Particle Size Distribution | % | | % | % |
| +⅝" | 0.5 | — | 0.4 | 0.4 |
| +½" | 88.4 | — | 96.6 | 91.2 |
| +⅜" | 10.8 | — | 3.0 | 8.2 |
| +¼" | 0.2 | — | 0.0 | 0.2 |
| −¼" | 0.0 | — | 0.0 | 0.0 |

These examples demonstrate the appearance of an undesirable wet surface with little or no amounts of bentonite. The absence of bentonite produces a wet surface. The presence of small amounts of bentonite eliminates the occurance of wet surfaces.

The comparison of these examples also demonstrates that the use of a PAM/NaA/VA polymer binding agent with bentonite improves the green drop data for the resulting green balls.

These examples demonstrate a significant increase in the 18 inch green drop and dry crush tests experienced when the bentonite dose is increased.

EXAMPLE 9

The laboratory experimental procedure described above was used to prepare and test the green balls of taconite ore concentrate of this example. This example uses a PAM/NaA/VA polymer binding agent applied in an emulsion containing 29.5 percent active polymer. All samples apply bentonite in a dose of 4 pounds per tonne of taconite ore concentrate. A test wherein no polymer agent was utilized is provided for comparative purposes only. The results of data obtained on the green balls of this example are presented in Table 12.

TABLE 12

| | Polymer lb/Tonne | | | |
|---|---|---|---|---|
| Ball Properties | 0 | 0.6 | 0.8 | 1.0 |
| 18" Green Drop No. | 4.0 | 6.5[1] | 7.3[5] | 12.3 |
| Wet Crush, psi | 4.7 | 3.8[2] | 3.8[6] | 4.4 |
| Dry Drop No. | 3.0 | 2.4[3] | 2.5[7] | 2.7 |
| Dry Crush, psi | 5.6 | 5.3[4] | 6.0 | 4.9 |
| Surface Appearance | wet | moist | moist | dry/ smooth |
| Ball Shape | spherical | spherical | spherical | spherical |
| % Moisture | 8.1 | 9.7, 8.1 | 9.2, 8.3 | 8.3 |
| Initial Concentrate | | | | |

TABLE 12-continued

| Ball Properties | Polymer lb/Tonne 0 | 0.6 | 0.8 | 1.0 |
|---|---|---|---|---|
| Moisture | 9.3% | — | — | 9.3% |

[1]These results are an average of 2 runs 7.7 and 5.3.
[2]These results are an averaqe of 2 runs 3.9 and 3.7.
[3]These results are an average of 2 runs 2.5 and 2.3.
[4]These results are an average of 2 runs 5.5 and 5.1.
[5]These results are an average of 2 runs 8.2 (wetter concentrate) and 6.3.
[6]These results are an average of 2 runs 3.8 and 3.8.
[7]These results are an average of 2 runs 2.8 and 2.1.

This example demonstrates the significant increase in green drop test values obtained by increasing the dose of the polymer binding agent in a polymer binder system including small doses of bentonite. Also, of note is that the surface wetness of the green balls is reduced and eliminated as the concentration of the polymer is increased. Even though increased concentrations of the polymer binding agent provide additional dryness to the resulting green balls it is less expensive to obtain equivalent degrees of dryness by the addition of bentonite than with the use of additional polymer.

EXAMPLE 10

The laboratory experimental procedure described above was used to prepare and test the green balls of taconite ore concentrate of this example. This example uses polymer agents made of poly(acrylamide) and sodium acrylate copolymers in a water-in-oil emulsion. Each of the test of this example used a bentonite dose of 4 pounds per tonne and 1 pound of polymer per tonne of taconite ore concentrate. The tests wherein no polymer binding agent or no bentonite were used are provided for comparative purposes only. The results of data obtained on the green balls obtained from this example are presented in Table 13.

TABLE 13

| Mole % PAM/NaA | Dose lb/tonne | 18" Green Drop No. | Surface Appearance |
|---|---|---|---|
| 85/15 | 1.0 | 8.1 | moist |
| 76/24 | 1.0 | 6.7 | moist |
| 59/41 | 1.0 | 6.8 | moist |
| | 0.6 | 4.2 | moist |
| No Polymer Control | | 4.0 | wet |
| No Bentonite Control | | 3.1 | wet |

This example demonstrates that polymer binding agents of poly(acrylamide) and sodium acrylate are effective in the polymer binding system of this invention.

Example 11

The laboratory experimental procedure described above was used to prepare and test the sample of green balls of taconite ore concentrate of this example. In this example a powdered nonionic poly(acrylamide) binding agent was used. This binding agent is commercially available under the trade name BEN EX®. Bentonite was used in this example in concentrations of 4 pounds per tonne of taconite ore concentrate. The results of data obtained on the green balls obtained in this eample are presented in Table 14.

TABLE 14

| Ball Properties | Pounds of Polymer Per Tonne 0 | 0.03 | 0.18 | 0.24 | 0.30 | 0.60 |
|---|---|---|---|---|---|---|
| 18" Green Drop No. | 4.0 | 4.5 | 4.1 | 4.9, 5.0 | 5.0 | 7.0 |

TABLE 14-continued

| Ball Properties | Pounds of Polymer Per Tonne 0 | 0.03 | 0.18 | 0.24 | 0.30 | 0.60 |
|---|---|---|---|---|---|---|
| Wet Crush, psi | 4.7 | 3.9 | 3.4 | 3.7, 3.7 | — | — |
| Dry Drop | 3.0 | 2.3 | 2.0 | 2.3, 2.2 | — | — |
| Dry Crush | 5.6 | 4.6 | 4.5 | 4.9, 4.6 | — | — |
| Surface Appearance | wet | wet | wet/ muddy | moist | moist | moist |
| Ball Shape | spher-ical | spher-ical | spher-ical | spher-ical | spher-ical | spher-ical |
| % Moisture | 8.1 | 9.0 | 9.2 | 10.1, 8.4 | — | — |

This example demonstrates that a powdered polymer binding agent is operable in the binder system of this invention. This example also demonstrates that doses of the polymer binding agent as high as 0.6 pound per tonne to taconite ore concentrate are necessary with this polymer binding agent.

EXAMPLE 12

The laboratory experimental procedure described above was used to prepare and test the samples of green balls of taconite ore concentrate of this example. In this example a powdered copolymer of poly(acrylamide) and sodium acrylate is used as the polymer binding agent. This polymer binding agent is commercially available as SUPERFLOC 206. This example uses bentonite in a dose of 4 pounds per tonne of taconite ore concentrate. The test wherein no polymer binding agent was used is provided for comparison purposes only. The results of data obtained on the green balls obtained from this example are presented in Table 15.

TABLE 15

| Ball Properties | Pounds Polymer Per Tonne Control 0.0 | 0.24 |
|---|---|---|
| 18" Green Drop. No. | 4.0 | 8.1 |
| Wet Crush; psi | 4.7 | 3.5 |
| Dry Drop No. | 3.0 | 2.5 |
| Dry Crush, psi | 5.6 | 6.3 |
| Surface Appearance | wet | moist |
| Ball Shape | spherical | spherical |
| % Moisture | 8.1 | 9.3 |
| Initial Concentrate Moisture | 9.3% | 9.8% |

This example demonstrates that a powdered copolymer of poly(acrylamide) and sodium acrylate is operable in the polymer binding system in this invention.

EXAMPLE 13

The laboratory experimental procedure described above was used to prepare and test the samples of green balls of taconite ore concentrate of this example. This example uses a powdered mixture of equal portions of bentonite and a copolymer. The copolymer is methyl vinyl ether and maleic anhydride. The bentonite is applied in a dose of 4 pounds per tonne of taconite ore concentrate. The test data wherein no polymer or no polymer and bentonite are used, is provided for comparative purposes only. The results of data obtained on the green balls obtained by this example are presented in Table 16.

TABLE 16

| Dose lb/tonne | 18" Green Drop No. | Surface Appearance | % Moisture |
|---|---|---|---|
| 0.18 | 4.3 | wet | 9.4 |
| 0.30 | 4.1 | moist | — |
| 0.60 | 4.1 | moist | — |
| No Polymer control | 4.0 | wet | 8.1 |
| No Bentonite No Polymer Control | 3.1 | wet | 8.6 |

This example demonstrates that only negligible improvements occurred at the dose range used for the polymer binding agent of this example.

EXAMPLE 14

The laboratory experimental procedure described above was used to prepare and test the samples of green balls of taconite ore concentrate of this example. The polymer binding agents of this example were applied as powders in binding systems having a bentonite dose of 4 pounds per tonne. The test conducted without a polymer binding agent is provided for comparison purposes only. The results of data obtained on the green balls obtained from this example are presented in Table 17.

TABLE 17

| Polymer | Dose lb/tonne | 18" Green Drop No. | Surface Appearance | % Moisture |
|---|---|---|---|---|
| Guar Gum HV490 | 0.6 | 5.1 | moist | 9.2 |
| Hydroxyethyl Cellulose QP100MH | 0.6 | 4.8 | moist | — |
| Carboxymethyl Cellulose Hercules 9H4F | 0.6 | 13.0 | dry | — |
| Carboxymethyl Cellulose Hercules 9H4F | 0.18 | 6.1 | moist | — |
| Poly(ethylene-oxide) WSR 301 | 0.06 | 6.7 | moist | 9.0 |
| Poly(acrylic-acid) 250,000 MW | 0.06 | 5.1 | moist | 9.5 |
| Control No Polymer | 0 | 4.1 | wet/moist | 9.5 |

This example demonstrates that a variety of polymer binding agents including high molecular weight and low molecular weight, natural and synthetic polymers are useful in the binding system of this invention.

EXAMPLE 15

The laboratory experimental procedure described above was used to prepare and test the samples of green balls of taconite ore concentrate of this example. This example uses polymer binding agents of acrylamide with a bentonite dose of 4 pounds per tonne. In each test the polymer binding agent is applied in a water-in-oil emulsion. The acrylamide polymer binding agents of this example comprise either all acrylamide monomers or copolymers of poly(acrylamide) and sodium acrylate. The results of data obtained on the green balls obtained from this example are presented in Table 18.

TABLE 18

| Test No. | Dose lb/tonne | 18 inch Green Drop | Surface Appearance | % Moisture |
|---|---|---|---|---|
| 85% POLY(ACRYLAMIDE)/15% SODIUM ACRYLATE | | | | |
| 1 | 0.6 | 6.3 | moist | 9.4 |
| 2 | 1.0 | 7.9 | moist | 9.4 |
| 3 | 2.0 | 11.7 | moist | 9.6 |
| 76% POLY(ACRYLAMIDE)/24% SODIUM ACRYLATE | | | | |
| 4 | 0.6 | 4.9 | moist | 9.4 |
| 5 | 1.0 | 6.6 | moist | 9.6 |
| 6 | 2.0 | 8.9 | moist | 9.5 |
| 59% POLY(ACRYLAMIDE)/41% SODIUM ACRYLATE | | | | |
| 7 | 0.6 | 4.7 | moist | 9.3 |
| 8 | 1.0 | 6.8 | moist | 9.4 |
| 9 | 2.0 | 11.6 | moist | 9.6 |
| 100% POLY(ACRYLAMIDE) | | | | |
| 10 | 0.6 | 4.8 | moist | 8.8 |
| 11 | 0.8 | 5.1 | moist | 9.9 |
| 12 | 1.0 | 6.1 | moist | 9.0 |
| 13 | 2.0 | 6.9 | moist | 10.1 |

This example demonstrates that various poly(acrylamide) based polymers are suitable for use in the polymer binding system of this invention. This example also demonstrates that increasing the concentration of the polymer binding agent in the binding system of this invention improves the physical characteristics of the green balls obtained.

EXAMPLE 16

This example illustrates a plant test in which the present invention was used to prepare flux pellets. Green balls of the composition set forth in Table 19 were prepared by agglomeration and were then fired in a continuous process 45 foot high shaft furnace. Results obtained in tests of the green balls and the resulting pellets are also presented in Table 19. Test numbers 1 and 2 of this example represent the prior art and are included for comparative purposes only.

TABLE 19

| | Binder lb/Wet Tonne | | | Taconite Feed[1] | | | | Green Ball Properties | | | Pellet Properties | |
|---|---|---|---|---|---|---|---|---|---|---|---|---|
| Test No. | Bentonite | CMC | Polymer | Grind[2] | Blaine[3] | Flux Ratio | % Silica | % $H_2O$ | Green Drop | Dry Crush | % +¼" | Fired Comp. |
| 1 | 16.5 | 2.7 | 0.0 | 90.98 | 2136 | 0.66 | 4.76 | 9.6 | 6.0 | 4.5 | --.- | ---/--- |
| 2 | 26.0 | 0.0 | 0.0 | 90.50 | 2181 | 0.61 | 4.68 | 9.8 | 5.7 | 9.1 | 94.4 | 438/169[4] |
| 3 | 21.0 | 0.0 | 0.9 | 91:14 | 2240 | 0.61 | 4.72 | 9.6 | 5.4[5] | 4.7 | 94.0 | 582/266 |
| 4 | 15.0 | 0.0 | 0.9 | 93.03 | 2210 | 0.90[6] | 4.35 | 9.7 | 6.2 | 9.6 | 94.4 | 427/118 |
| 5 | 16.5 | 0.0 | 0.9 | 91.06 | 2196 | 0.87[6] | 4.20 | 10.0 | 6.4 | 6.8 | 94.4 | 464/156 |

[1]Taconite used was at a moisture level of about 10%.
[2]Grind refers to the % of taconite < 325 mesh
[3]Blaine is a relative index of the surface area in $cm^2$ of a volume of taconite concentrate
[4]Fired Compression/Standard Deviation
[5]Average figure
[6]Obtained by adding a 50/50 mixture of dolomite/$C_aCO_3$ This example illustrates the outstanding performance afforded by the present invention when making a flux pellet. Pellets with consistently excellent Q-index values and outstanding fired compression were obtained at the flux and silica levels set forth, while still yielding balls with good green drop and dry crush figures.

EXAMPLE J

The laboratory experimental procedure described above was use to prepare and test the sample green balls of taconite ore concentrate of this example. The polymer binding agents used in this example are copolymers of poly(acrylamide) and dimethyl diallyl ammonium chloride (DMDAC) in a water-in-oil emulsion. The polymer binding system of this example contains a bentonite dose of 4 pounds per tonne of taconite ore concentrate. The results of data obtained on the green balls obtained from this example are presented in Table 20.

TABLE 20

| Polymer | Dose lb/tonne | 18" Green Drop No. | Surface Appearance | % Moisture |
|---|---|---|---|---|
| 50/50 PAM/ DMDAC | 0.8 | 4.2 | moist | — |
| 70/30 PAM/ DMDAC | 0.8 | 4.1 | moist | — |
| | 2.0 | 4.1 | moist | |
| Control | 0.0 | 4.1 | wet/moist | 9.5 |

The example demonstrates that the two cationic copolymers tested, which were 30% active polymers, did not function within the polymer binder system of this invention at the doses tested.

EXAMPLE K

The laboratory experimental procedure described above was used to prepare and test the samples of green balls of taconite ore concentrate of this example. In this example starch was used as the polymer agent. The starch used is commercially available by the brand name DURABOND A. Bentonite was used in the binding system of this example in a dose of 4 pounds per tonne of taconite ore concentrate. The results of data obtained on the green balls obtained from this example are presented in Table 21.

TABLE 21

| | 18" Green Drop | Surface Appearance | % Moisture |
|---|---|---|---|
| 0.6 lb starch/tonne and 4 lb/tonne bentonite | 4.1 | moist | 9.8 |

This example demonstrates that starch is not operable as a polymer binding agent in the binding system of this invention at the concentration tested.

EXAMPLE 17

Following the procedures used for preparing and testing green balls described above for Example 1, dispersions of fine particles of a polyacrylamide polymer in an oil dispersion medium were added to taconite concentrate from the Mesabi range at the rate of 0.36 pounds of dispersion product per tonne (for an effective rate of 0.18 pounds of polymer per tonne). These dispersions contained 50 weight percent light mineral oil, fifty weight percent polymer and essentially no water. In all cases, bentonite was also added at the rate of 9 pounds per tonne. The results obtained are set forth on Table 22.

These dispersions varied in the polyelectrolyte charge density that they exhibited, as shown under the column headed "charge" in Table 22. The non-ionic polymer used in Test 1 was obtained as an acrylamide homopolymer believed to have had an I.V. of about 15. The anionic polymers of Tests 2 and 3 were obtained as copolymers of acrylamide and sodium acrylate; I.V., about 15. The polymers of Tests 4 and 5 were prepared from acrylamide and quaternary salts of dimethylaminomethyl methacrylate; I.V., about 7 to 15.

As a control, a water-in-oil emulsion which contained 30 weight percent of a copolymer prepared from acrylamide monomers and sodium acrylate monomers (approximately 50/50 weight percent) was added at the rate of 0.6 pounds per tonne (for an effective rate of 0.18 pounds of polymer per tonne) with bentonite added at the rate of 9 pounds per tonne. The results are also set forth on Table 21.

TABLE 21

| Test | Ionic Character | Charge | Green Drop | Green Crush | Dry Crush | % $H_2O$ in Balls |
|---|---|---|---|---|---|---|
| 1 | Non-ionic | None | 5.2 | 4.7 | 11.4 | 9.4 |
| 2 | Anionic | Med. | 10.1 | 4.4 | 10.9 | 9.6 |
| 3 | Anionic | High | 6.5 | 4.1 | 9.9 | 9.4 |
| 4 | Cationic | Med. | 5.6 | 4.7 | 13.3 | 9.4 |
| 5 | Cationic | V. High | 5.4 | 4.9 | 11.5 | 9.5 |
| Control | Anionic | Med. | 7.0 | 4.7 | 9.6 | 9.7 |

We claim:

1. A process of agglomerating a particulate material, comprising:

commingling said particulate material with at least two binder system components;

(i) a first component being a binding amount of a water-soluble, binding polymer, said polymer being applied to said particulate material as a dispersion in a non-aqueous dispersion medium; and (ii) a second component being a clay, said clay being applied to said particulate material in an amount up to about 12 pounds per tonne of said particulate material.

2. The process of claim 1 in which the polymer is contained in the aqueous portion of a water-in oil emulsion.

3. The process of claim 1 in which fine particles of polymer are dispersed in the dispersion medium.

4. The process of claim 1 wherein said polymer is a poly(acrylamide) based polymer.

5. The process of claim 4 wherein said polymer contains repeating units of the following formula:

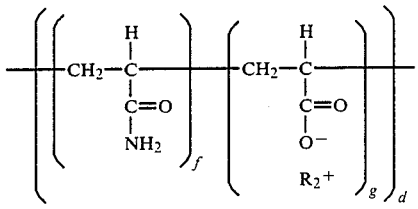

wherein $R_2+$ is an alkali metal ion, and f is from 5 to about 90 percent, g is from 5 to about 90 percent, (f)+(g) equal 100 percent, and (d) is an integer of from about 1,000 to about 500,000.

6. The process of claim 5 wherein said polymer is derived from monomer units of acrylamide and sodium acrylate.

7. The process of claim 4 wherein said polymer contains repeating units of the following formula:

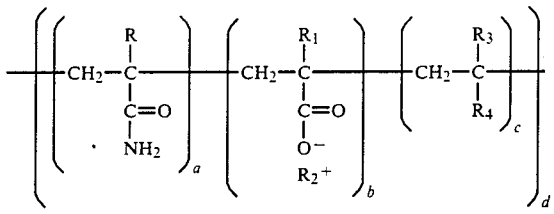

wherein R, $R_1$ and $R_3$ are independently hydrogen or methyl, $R_2^+$ is an alkali metal ion, $R_4$ is either (1) $—OR_5$ wherein $R_5$ is an alkyl group having up to 5 carbon atoms;

(2)

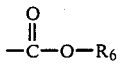

wherein $R_6$ is an alkyl group having up to 8 carbon atoms;

(3)

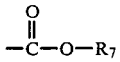

wherein $R_7$ is either methyl, or butyl;

(4) phenyl;

(5) substituted phenyl;

(6) —CN; or (7)

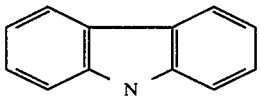

and hydrolized tetrapolymers thereof, wherein (a) is from about 5 to about 90 percent, (b) is from 0 to about 90 percent, (c) is from about 0 to about 20 percent, (a)+(b)+(c) equal 100 percent, and (d) is from about 1,000 to about 500,000.

8. The process of claim 7 wherein said polymer is derived from monomer units of acrylamide, sodium acrylate and vinyl acetate.

9. The process of claim 4 wherein said polymer is derived from monomer units of the formula:

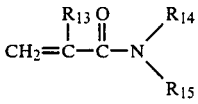

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation.

10. The process of claim 4 wherein said binding amount of said polymer is applied to said particulate material at an active polymer concentration on said particulate material between about 0.001 percent and about 0.3 percent by weight.

11. The process of claim 4 wherein said particulate material is taconite concentrate.

12. The process of claim 11 wherein said clay is bentonite.

13. A product of the process of claim 1.

14. A product of the process of claim 12.

15. A process for manufacturing agglomerated mineral ore pellets, comprising:

(a) commingling:

(i) a binding amount of a water-soluble, binding polymer dispersed in a non-aqueous dispersion medium onto a taconite mineral ore; and (ii) bentonite, said bentonite being applied to said taconite in an amount up to about 12 pounds per tonne of said taconite, thereby forming a composition of said polymer, taconite and bentonite;

(b) agglomerating said composition to form green balls by a means for balling mineral ore concentrate; and (c) firing said green balls by a means for applying sufficient heat to indurate said green balls and form pellets thereby.

16. The process of claim 15 wherein said polymer is a poly(acrylamide) based polymer.

17. The process of claim 16 wherein said polymer is derived from monomer units of the formula:

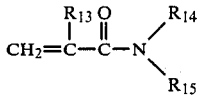

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $R_{16}—SO_3X$, wherein $R_{16}$ is a divalent hydrocarbon group having 1 to 13 carbon atoms and X is a monovalent cation, or repeating units of the formula:

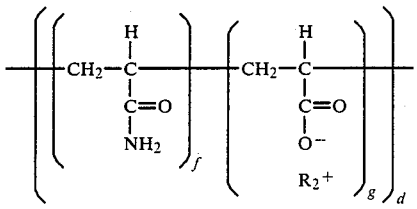

wherein $R_2^+$ is an alkali metal ion, and f is from 5 to about 90 percent, g is from 5 to about 90 percent, (f)+(g) equal 100 percent, and (d) is from about 1,000 to about 500,000.

18. A product of the process of claim 17.

19. A process of agglomerating a particulate material, comprising:

commingling said particulate material with at least two binder system components;

(i) a first component being a binding amount of a water-soluble, binding poly(acrylamide) or poly(ethylene oxide) based polymer, said polymer being applied to said particulate material as a dry powder; and (ii) a second component being a clay, said clay being applied in an amount up to about 12 pounds per tonne of said particulate material.

20. The process of claim 19, wherein said first binding polymer is a poly(ethylene oxide) based polymer.

21. The process of claim 19, wherein said first binding polymer is a poly(acrylamide) based polymer.

22. The process of claim 21 wherein said polymer contains repeating units of the following formula:

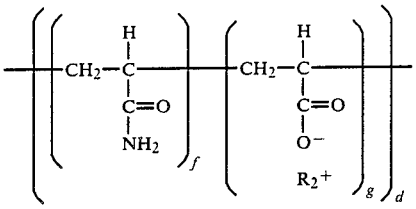

wherein $R_2^+$ is an alkali metal ion, and f is from 5 to about 90 percent, g is from 5 to about 90 percent, (f)+(g) equal 100 percent, and (d) is an integer of from about 1,000 to about 500,000.

23. The process of claim 22 wherein said polymer is derived from monomer units of acrylamide and sodium 24. The process of claim 21 wherein said polymer contains repeating units of the following formula:

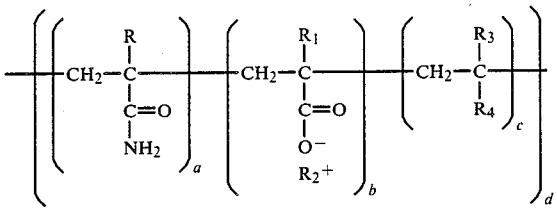

wherein R, $R_1$ and $R_3$ are independently hydrogen or methyl, $R_2^+$ is an alkali metal ion, $R_4$ is either (1) $—OR_5$ wherein $R_5$ is an alkyl group having up to 5 carbon atoms;

(2)

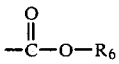

wherein $R_6$ is an alkyl group having up to 8 carbon atoms;

(3)

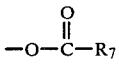

wherein $R_7$ is either methyl or ethyl;

(4) phenyl;

(5) substituted phenyl;

(6) —CN; or (7)

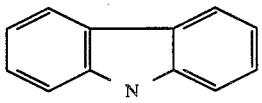

and hydrolized tetrapolymers thereof, wherein (a) is from about 5 to about 90 percent, (b) is from 0 to about 90 percent, (c) is from about 0 to about 20 percent, (a)+(b)+(c) equal 100 percent, and (d) is an integer of from about 1,000 to about 500,000.

25. The process of claim 24 wherein said polymer is derived from monomer units of acrylamide, sodium acrylate and vinyl acetate.

26. The process of claim 21 wherein said polymer is derived from monomer units of the formula:

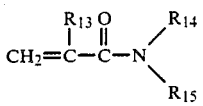

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation.

27. The process of claim 26 wherein said binding amount of said polymer is applied to said particulate material mineral ore concentrate at an active polymer concentration in said concentrate between about 0.001 percent and about 0.3 percent by weight of dry concentrate.

28. The process of claim 21 wherein said particulate material is taconite concentrate.

29. The process of claim 28 wherein said clay is bentonite.

30. A product of the process of claim 19.

31. A product of the process of claim 29.

32. The process of claim 19 wherein said first binder component also includes a polysaccharide polymer.

33. The process of claim 32 wherein said polysaccharide polymer is selected from the group consisting of carboxymethyl cellulose, guar gum, hydroxyethyl cellulose, and mixtures thereof.

34. A product of the process of claim 33.

35. A process of manufacturing agglomerated mineral ore pellets, comprising:

(a) commingling:

(i) a binding amount of a water-soluble binding poly(acrylamide) or poly(ethylene oxide) based polymer, said polymer being applied to a taconite mineral ore as a dry powder; and (ii) bentonite, said bentonite being applied to said taconite in an amount up to about 12 pounds per tonne of said taconite. thereby forming a composition of said polymer, taconite and bentonite;

(b) agglomerating said composition to form green balls by a means for balling mineral ore concentrate; and (c) firing said green balls by a means for applying sufficient heat to indurate said green balls and form pellets thereby.

36. The process of claim 35, wherein said first binder component is a poly(ethylene oxide) based polymer.

37. The process of claim 35 wherein said polymer contains repeating units of the following formula:

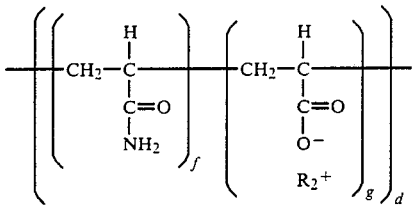

wherein $R_2^+$ is an alkali metal ion, and f is from 5 to about 90 percent, g is from 5 to about 90 percent, (f)+(g) equal 100 percent, and (d) is an integer of from about 1,000 to about 500,000.

38. The process of claim 37 wherein said polymer is derived from monomer units of acrylamide and sodium acrylate.

39. The process of claim 35 wherein said polymer contains repeating units of the following formula:

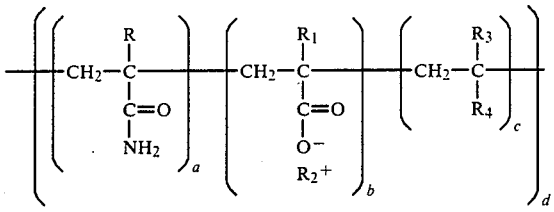

wherein R, $R_1$ and $R_3$ are independently hydrogen or methyl, $R_2^+$ is an alkali metal ion, $R_4$ is either (1) $—OR_5$ wherein $R_5$ is an alkyl group having up to 5 carbon atoms;

(2)

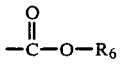

wherein $R_6$ is an alkyl group having up to 8 carbon atoms;

(3)

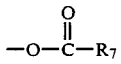

wherein $R_7$ is either methyl or ethyl;

(4) phenyl;

(5) substituted phenyl;

(6) —CN; or (7)

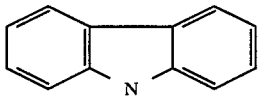

and hydrolized tetrapolymers thereof, wherein (a) is from about 5 to about 90 percent, (b) is from 0 to about 90 percent, (c) is from about 0 to about 20 percent, (a)+(b)+(c) equal 100 percent, and (d) is an integer of from about 1,000 to about 500,000.

40. The process of claim 39 wherein said polymer is derived from monomer units of acrylamide, sodium acrylate and vinyl acetate.

41. The process of claim 35 wherein said polymer is derived from monomer units of the formula:

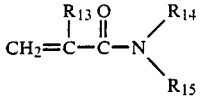

wherein $R_{13}$ is a hydrogen atom or a methyl group; $R_{14}$ is a hydrogen atom, a methyl group or an ethyl group; $R_{15}$ is a hydrogen atom, a methyl group, an ethyl group or $—R_{16}—SO_3X$, wherein $R_{16}$ is a divalent hydrocarbon group having 1 to 13 carbon atoms and X is a monovalent cation.

42. The process of claim 35 wherein said binding amount of said polymer is applied to said particulate material mineral ore concentrate at an active polymer concentration in said concentrate between about 0.001 percent and about 0.3 percent by weight of dry concentrate.

43. The process of claim 37 wherein said particulate material is taconite concentrate.

44. The process of claim 43 wherein said clay is bentonite.

45. A product of the process of claim 35.

46. A product of the process of claim 44.

47. A process for manufacturing agglomerated mineral ore flux pellets, comprising:

(a) commingling:

(i) a binding amount of a water-soluble, binding polymer dispersed in a non-aqueous dispersion medium onto a taconite mineral ore;

(ii) bentonite, said bentonite being applied to said taconite in an amount up to about 25 pounds per tonne of said taconite; and (iii) an inorganic material, thereby forming a composition of said polymer, bentonite and inorganic material, said composition having a basicity ratio of about 0.60 or higher;

(b) agglomerating said composition to form green balls by a means for balling mineral ore concentrate; and (c) firing said green balls by a means for applying sufficient heat to indurate said green balls and produce pellets thereby.

48. The process of claim 47, wherein said polymer is a poly(acrylamide) based polymer.

49. The process of claim 48 wherein said polymer contains repeating units of the following formula:

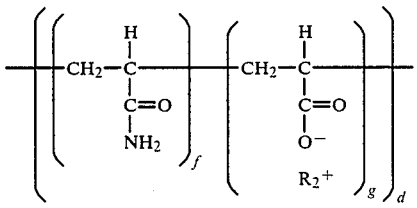

wherein $R_2^+$ is an alkali metal ion, and f is from 5 to about 90 percent, g is from 5 to about 90 percent, (f)+(g) equal 100 percent, and (d) is an integer of from about 1,000 to about 500,000.

50. The process of claim 49 wherein said polymer is derived from monomer units of acrylamide and sodium acrylate.

51. The process of claim 48 wherein said polymer contains repeating units of the following formula:

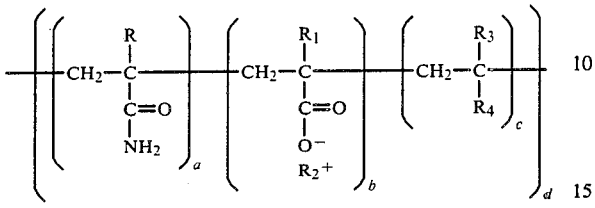

wherein R, $R_1$ and $R_3$ are independently hydrogen or methyl, $R_2+$ is an alkali metal ion, $R_4$ is either (1) $—OR_5$ wherein $R_5$ is an alkyl group having up to 5 carbon atoms;

(2)

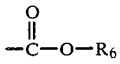

wherein $R_6$ is an alkyl group having up to 8 carbon atoms;

(3)

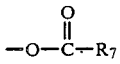

wherein $R_7$ is either methyl or ethyl;

(4) phenyl;

(5) substituted phenyl;

(6) —CN; or (7)

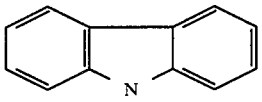

and hydrolized tetrapolymers thereof, wherein (a) is from about 5 to about 90 percent, (b) is from 0 to about 90 percent, (c) is from about 0 to about 20 percent, (a)+(b)+(c) equal 100 percent, and (d) is an integer of from about 1,000 to about 500,000.

52. The process of claim 51 wherein said polymer is derived from monomer units of acrylamide, sodium acrylate and vinyl acetate.

53. The process of claim 48 wherein said bentonite is applied in an amount up to about 20 pounds per tonne of taconite.

54. The process of claim 53 wherein said bentonite is applied in an amount up to about 10 pounds per tonne of taconite.

55. The process of claim 48 wherein sodium carbonate is commingled with said inorganic material selected to make the flux pellet.

56. A process for manufacturing agglomerated mineral ore flux pellets, comprising:

(a) commingling:

(i) a binding amount of a water-soluble, binding polymer, said polymer applied as a dry powder onto a taconite mineral ore;

(ii) bentonite, said bentonite being applied to said taconite in an amount up to about 25 pounds per tonne of said taconite; and (iii) an inorganic material, thereby forming a composition of said polymer, bentonite and inorganic material, said composition having a basicity ratio of about 0.60 or higher;

(b) agglomerating said composition to form green balls by a means for balling said mineral ore concentrate; and (c) firing said green balls by a means for applying sufficient heat to indurate said green balls and produce pellets thereby.

57. The process of claim 56, wherein said polymer is a poly(acrylamide) base polymer.

58. The process of claim 57 wherein said polymer contains repeating units of the following formula:

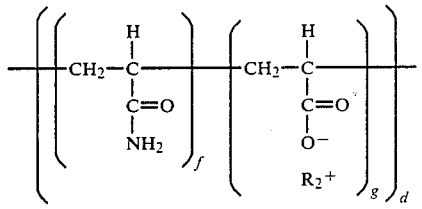

wherein $R_2+$ is an alkali metal ion, and f is from 5 to about 90 percent, g is from 5 to about 90 percent, (f)+(g) equal 100 percent, and (d) is an integer of from about 1,000 to about 500,000.

59. The process of claim 58 wherein said polymer is derived from monomer units of acrylamide and sodium acrylate.

60. The process of claim 57 wherein said polymer contains repeating units of the following formula:

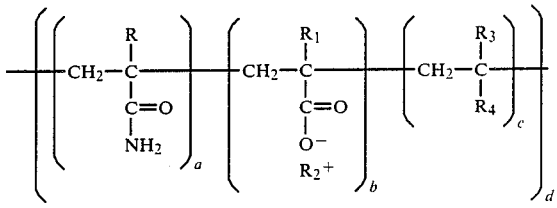

wherein R, $R_1$ and $R_3$ are independently hydrogen or methyl, $R_2+$ is an alkali metal ion, $R_4$ is either (1) $—OR_5$ wherein $R_5$ is an alkyl group having up to 5 carbon atoms;

(2)

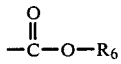

wherein $R_6$ is an alkyl group having up to 8 carbon atoms;

(3)

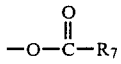

wherein $R_7$ is either methyl or ethyl;

(4) phenyl;

(5) substituted phenyl;

(6) —CN; or (7)

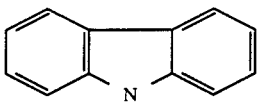

;

and hydrolized tetrapolymers thereof, wherein (a) is from about 5 to about 90 percent, (b) is from 0 to about 90 percent, (c) is from about 0 to about 20 percent, (a)+(b)+(c) equal 100 percent, and (d) is an integer of from about 1,000 to about 500,000.

61. The process of claim 60 wherein said polymer is derived from monomer units of acrylamide, sodium acrylate and vinyl acetate.

62. The process of claim 57 wherein said bentonite is applied in an amount up to about 20 pounds per tonne of taconite.

63. The process of claim 62 wherein said bentonite is applied in an amount up to about 10 pounds per tonne of taconite.

64. The process of claim 57 wherein sodium carbonate is commingled with said inorganic material selected to make the flux pellet.

65. A product of the process of claim 48.

66. A product of the process of claim 57.

* * * * *